US010865753B2

(12) United States Patent
Niwa et al.

(10) Patent No.: US 10,865,753 B2
(45) Date of Patent: Dec. 15, 2020

(54) FUEL INJECTION VALVE

(71) Applicant: DENSO CORPORATION, Kariya (JP)

(72) Inventors: Masayuki Niwa, Nisshin (JP); Noritsugu Kato, Kariya (JP)

(73) Assignee: DENSO CORPORATION, Kariya (JP)

( * ) Notice: Subject to any disclaimer, the term of this patent is extended or adjusted under 35 U.S.C. 154(b) by 145 days.

(21) Appl. No.: 16/071,181

(22) PCT Filed: Jan. 13, 2017

(86) PCT No.: PCT/JP2017/000938
§ 371 (c)(1),
(2) Date: Jul. 19, 2018

(87) PCT Pub. No.: WO2017/141592
PCT Pub. Date: Aug. 24, 2017

(65) Prior Publication Data

US 2019/0093617 A1 Mar. 28, 2019

(30) Foreign Application Priority Data

Feb. 15, 2016 (JP) ..... 2016-025800

(51) Int. Cl.

| | |
|---|---|
| ***F02M 61/18*** | (2006.01) |
| ***F02M 51/06*** | (2006.01) |
| ***F02M 1/10*** | (2006.01) |
| ***F02M 61/10*** | (2006.01) |

(52) U.S. Cl.
CPC ..... *F02M 61/184* (2013.01); *F02M 51/06* (2013.01); *F02M 51/0614* (2013.01); *F02M 61/10* (2013.01); *F02M 61/18* (2013.01); *F02M 61/1886* (2013.01)

(58) Field of Classification Search
CPC .. F02M 61/184; F02M 51/06; F02M 51/0614; F02M 61/10; F02M 61/18; F02M 61/1886
See application file for complete search history.

(56) References Cited

U.S. PATENT DOCUMENTS

| | | | |
|---|---|---|---|
| 2006/0049286 | A1 | 3/2006 | Oomura et al. |
| 2015/0129687 | A1 | 5/2015 | Kaneta |

FOREIGN PATENT DOCUMENTS

| | | |
|---|---|---|
| JP | 2010-216412 | 9/2010 |
| JP | 2013-024087 | 2/2013 |

*Primary Examiner* — Arthur O. Hall
*Assistant Examiner* — Steven M Cernoch
(74) *Attorney, Agent, or Firm* — Nixon & Vanderhye P.C.

(57) ABSTRACT

An injection hole has an injection hole passage communicating an inner opening with an outer opening. The inner opening is smaller than the outer opening in cross-sectional area. The needle moves in a valve closing direction to abut against a valve seat to restrict a flow of fuel through the injection hole. A first inner wall of the injection hole is located on a valve closing direction side relative to an injection hole axis. A second inner wall of the injection hole is located on an opposite side of the injection hole axis from the valve closing direction side. The injection hole passage is defined by the first inner wall and the second inner wall.

15 Claims, 17 Drawing Sheets

FUEL INJECTION VALVE

CROSS REFERENCE TO RELATED APPLICATION

This application is the U.S. national phase of International Application No. PCT/JP2017/000938 filed Jan. 13, 2017, which designated the U.S. and claims priority to Japanese Patent Application No. 2016-25800 filed on Feb. 15, 2016, the entire contents of each of which are hereby incorporated herein by reference.

TECHNICAL FIELD

The present disclosure relates to a fuel injection valve.

BACKGROUND ART

In a fuel injection valve that injects and supplies a fuel to an internal combustion engine (hereinafter referred to as "engine"), diverse injection hole shapes have been proposed in order to optimize a fuel spray state in a combustion chamber of an engine. For example, Patent Literature 1 discloses a fuel injection valve that is provided with a nozzle body having an injection hole. The injection hole has a cross-sectional area that enlarges from an inner opening toward an outer opening, in which a protrusion portion is formed radially inward on an inner wall defining an injection hole passage. The injection hole passage communicates the inner opening of the injection hole with the outer opening.

In general, the fuel, which is to flow through the injection hole passage, flows in a direction which is not parallel to an injection hole axis before the fuel flows into the inner opening. The injection hole axis connects a center of the inner opening with a center of the outer opening. Therefore, a liquid film of the fuel is formed on a part of the inner wall defining the injection hole passage. In the fuel injection valve disclosed in Patent Literature 1, the protrusion portion is provided on the inner wall on which the liquid film of the fuel is formed so that the liquid film of the fuel spreads in a circumferential direction along the inner wall of the injection hole passage. However, when a range in which the liquid film of the fuel spreads varies, a range of the spread of the fuel in the combustion chamber, a spray shape, and the like vary. For that reason, a risk arises that spray characteristics of the fuel injected from the injection hole vary every time the fuel injection is performed.

PRIOR TECHNICAL LITERATURE

Patent Literature

Patent Literature 1: JP 2006-57462 A

SUMMARY OF INVENTION

It is an object of the present disclosure to provide a fuel injection valve that is to improve a stability of fuel spray characteristics.

According to one aspect of the present disclosure, a fuel injection valve comprises a nozzle body having an injection hole, which is configured to inject fuel, and a valve seat formed around an inner opening of the injection hole. The fuel injection valve further comprises a needle abuttable against the valve seat, the needle configured to restrict fuel from flowing between an inside and an outside of the nozzle body through the injection hole when the needle abuts against the valve seat and to permit fuel to flow between the inside and the outside of the nozzle body through the injection hole when the needle is lifted from the valve seat. The fuel injection valve further comprises a drive unit configured to move the needle back and forth. The injection hole is formed such that a cross-sectional area of the inner opening is smaller than a cross-sectional area of an outer opening of the injection hole. The needle is movable back and forth along a center axis of the nozzle body. The needle is movable in a valve closing direction along the center axis to abut against the valve seat. An injection hole passage of the injection hole communicates the inner opening with the outer opening. The injection hole passage is defined by a first inner wall and a second inner wall. The first inner wall is located on a valve closing direction side relative to an injection hole axis of the injection hole. The second inner wall is located on a side opposite to the valve closing direction side relative to the injection hole axis. The second inner wall is closer to the injection hole axis than the first inner wall.

BRIEF DESCRIPTION OF THE DRAWINGS

The above and other objects, features and advantages of the present disclosure will become more apparent from the following detailed description made with reference to the accompanying drawings. In the drawings.

Figure 7:
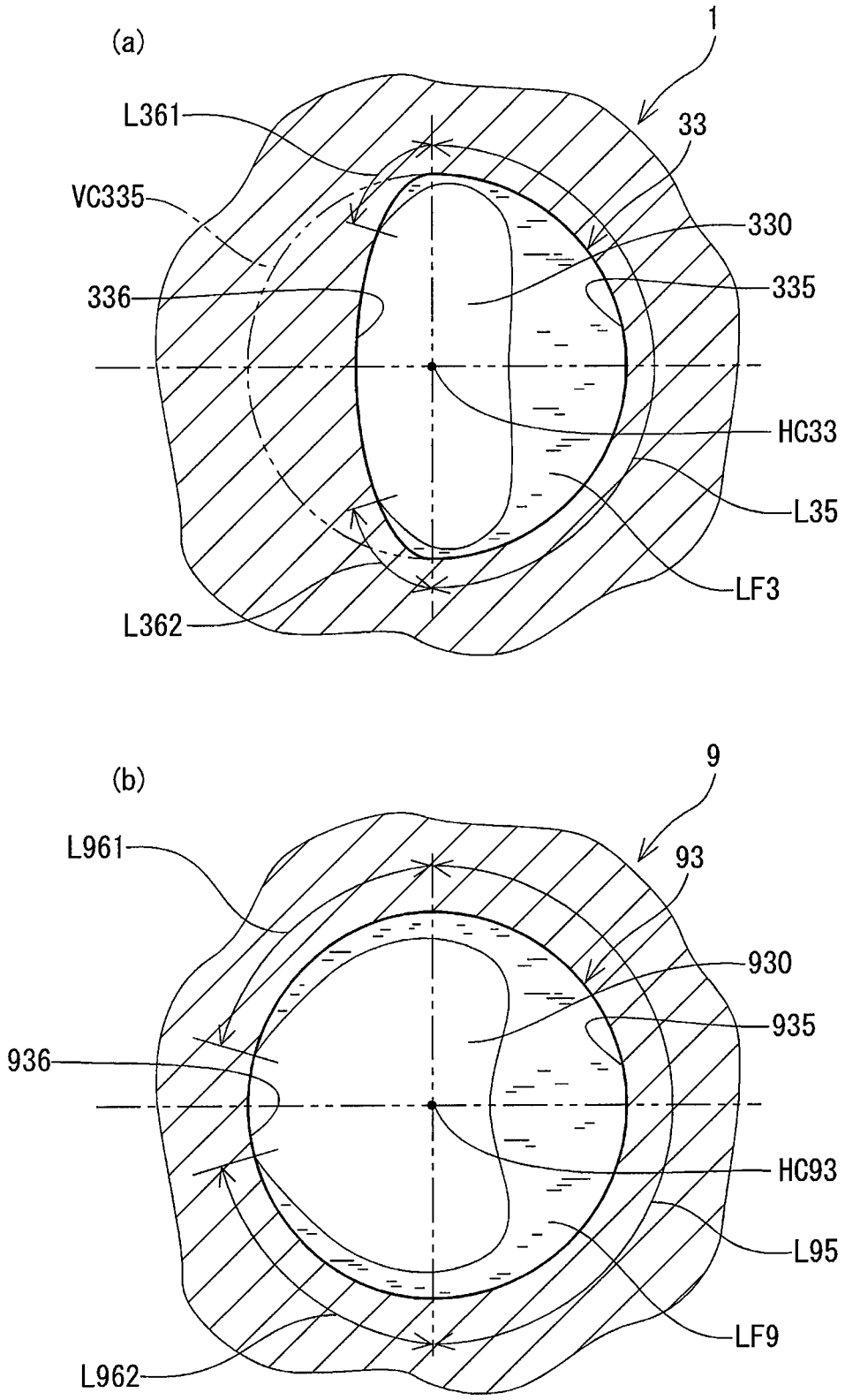
Figure 8:
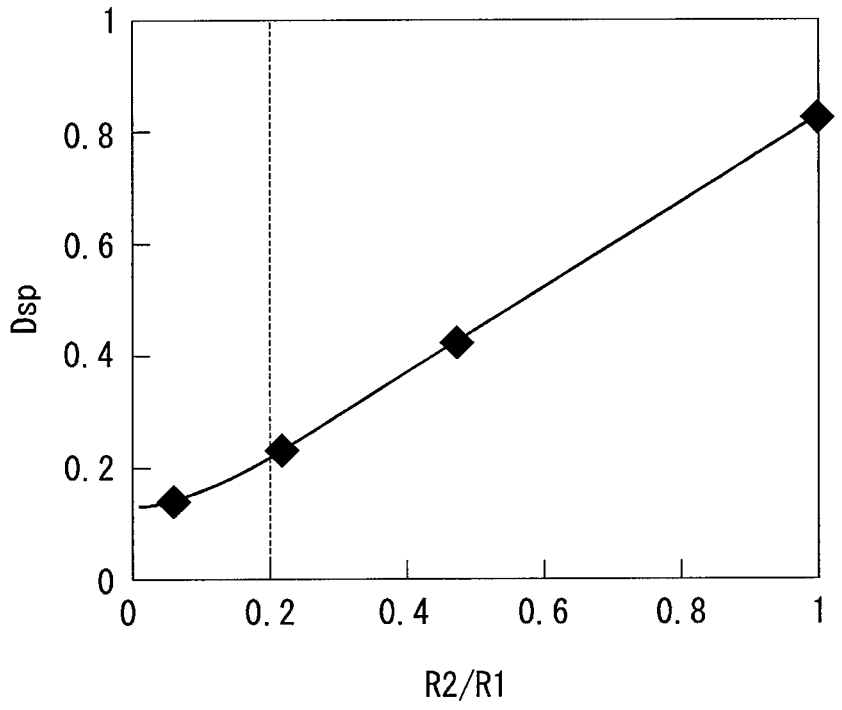
Figure 9:
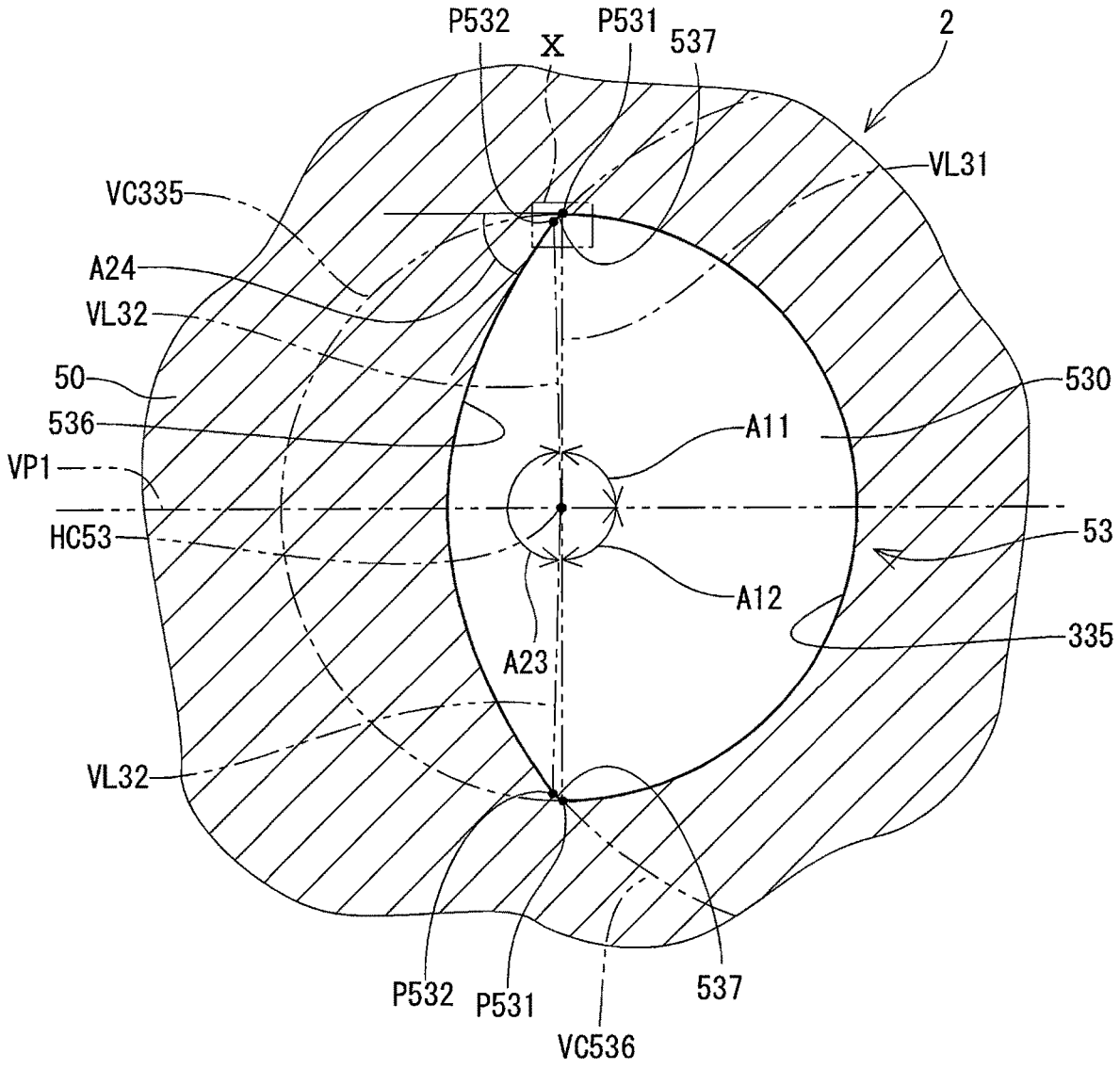
Figure 10:
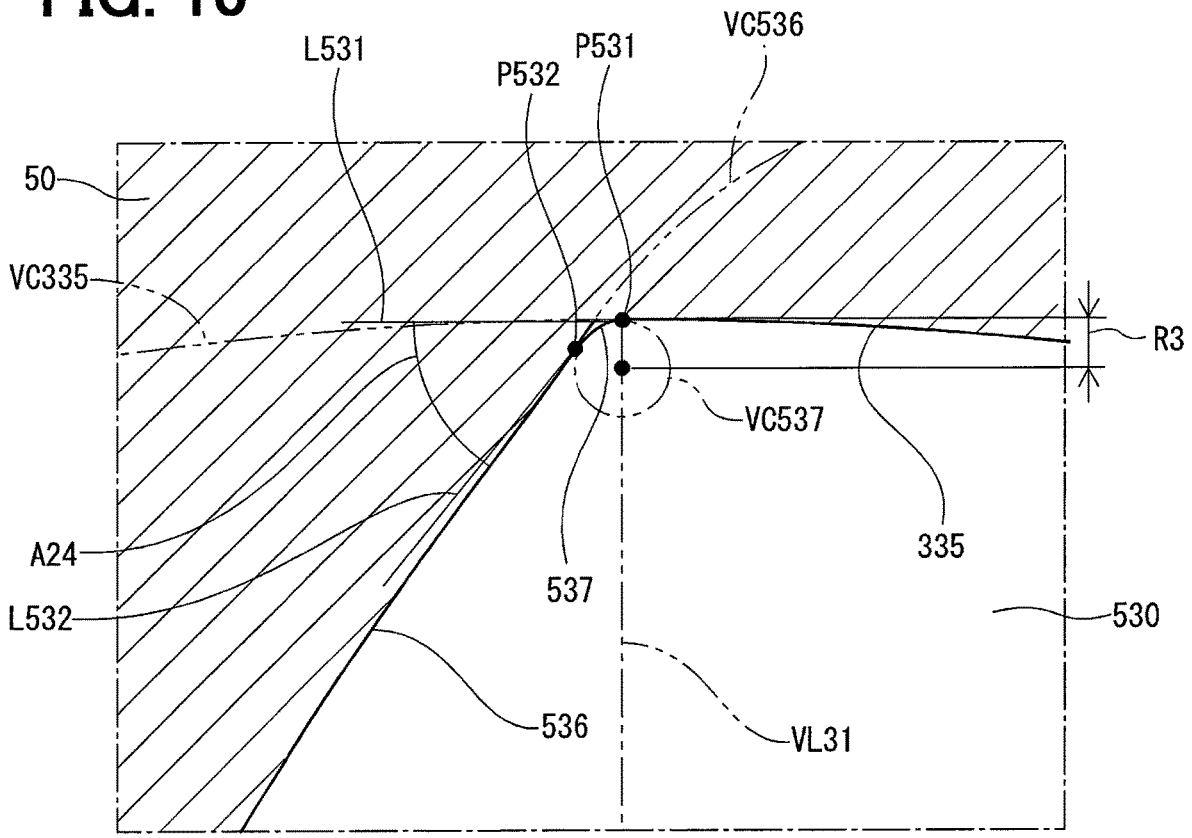
Figure 11:
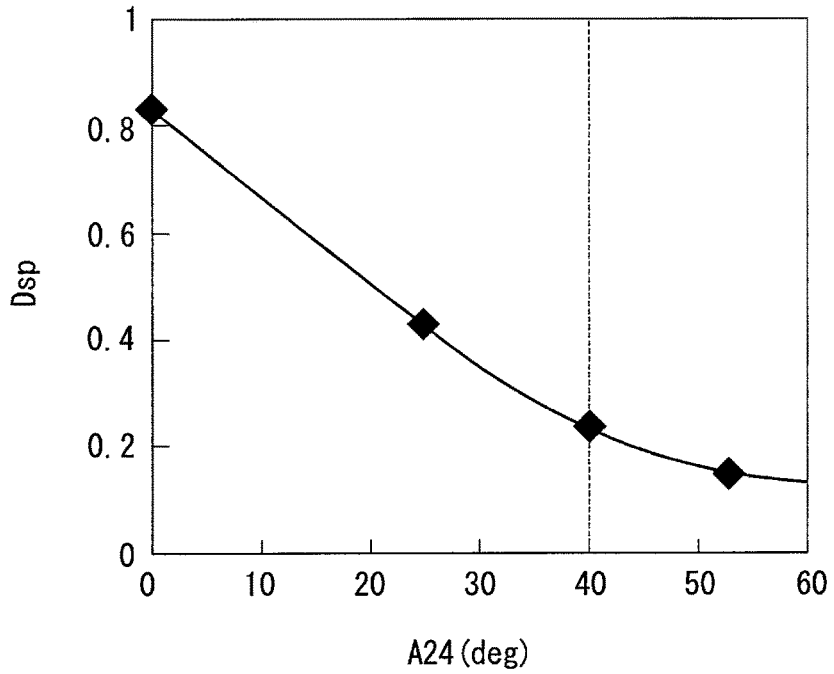
Figure 12:
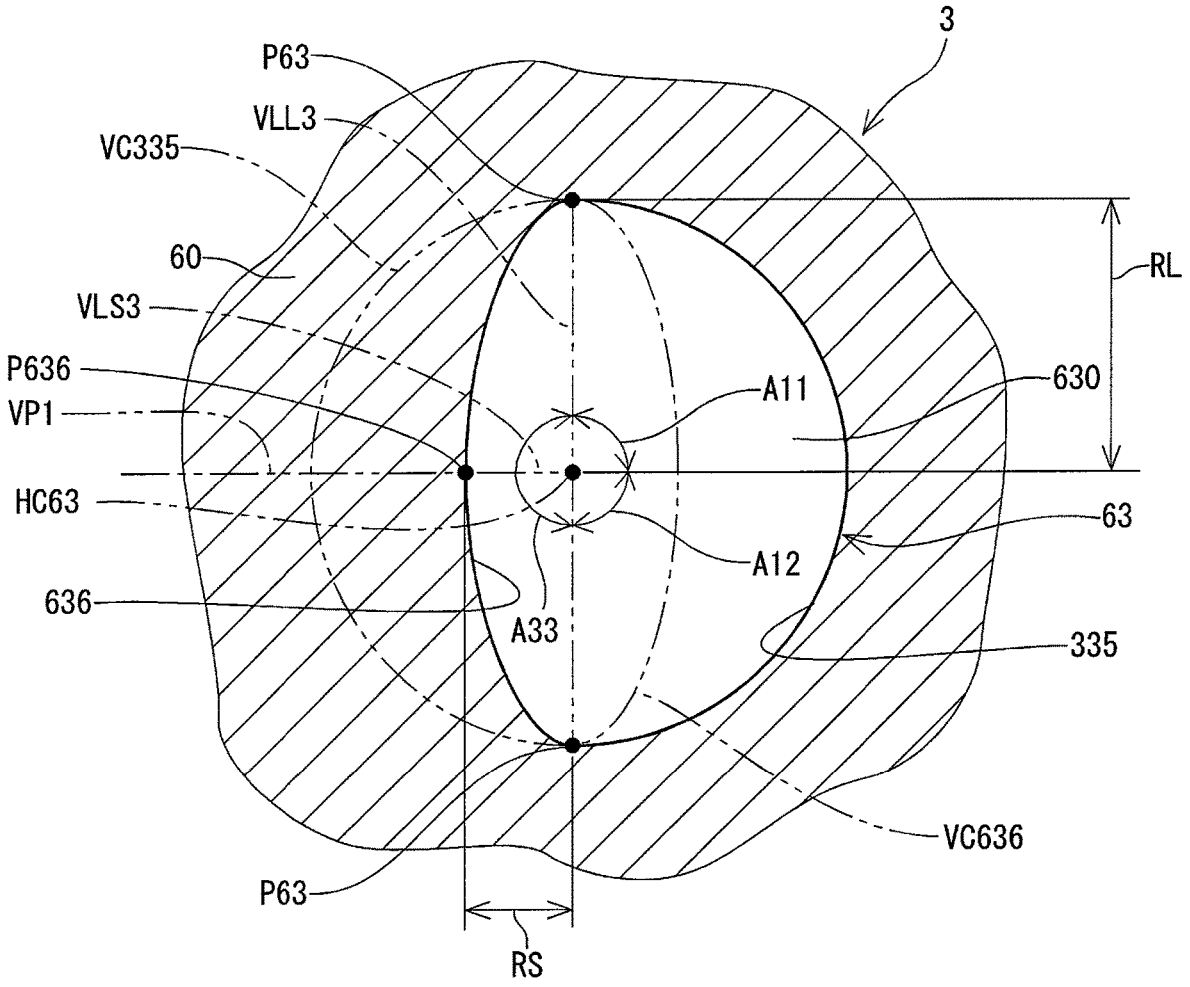
Figure 13:
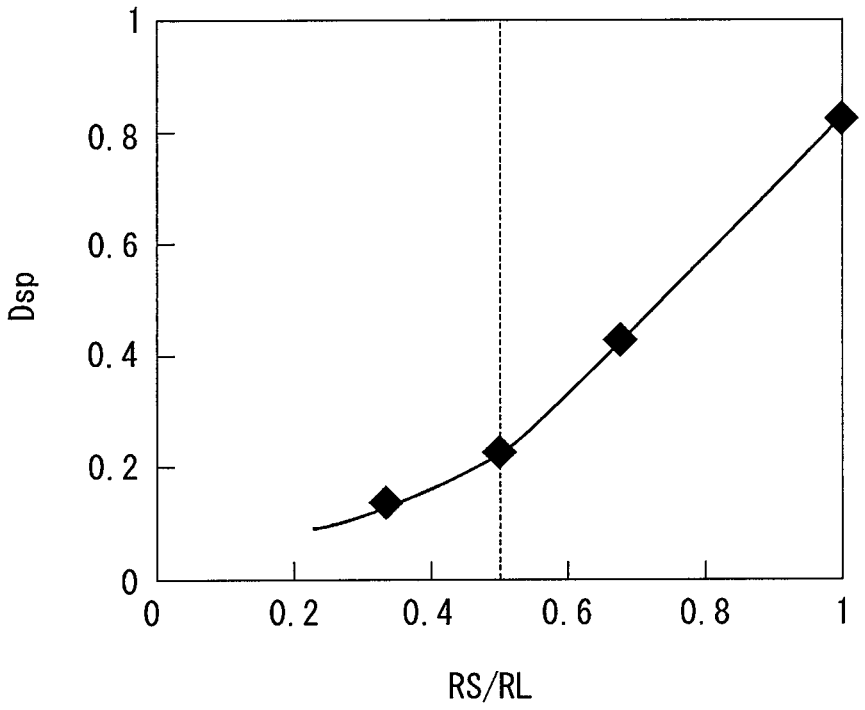
Figure 14:
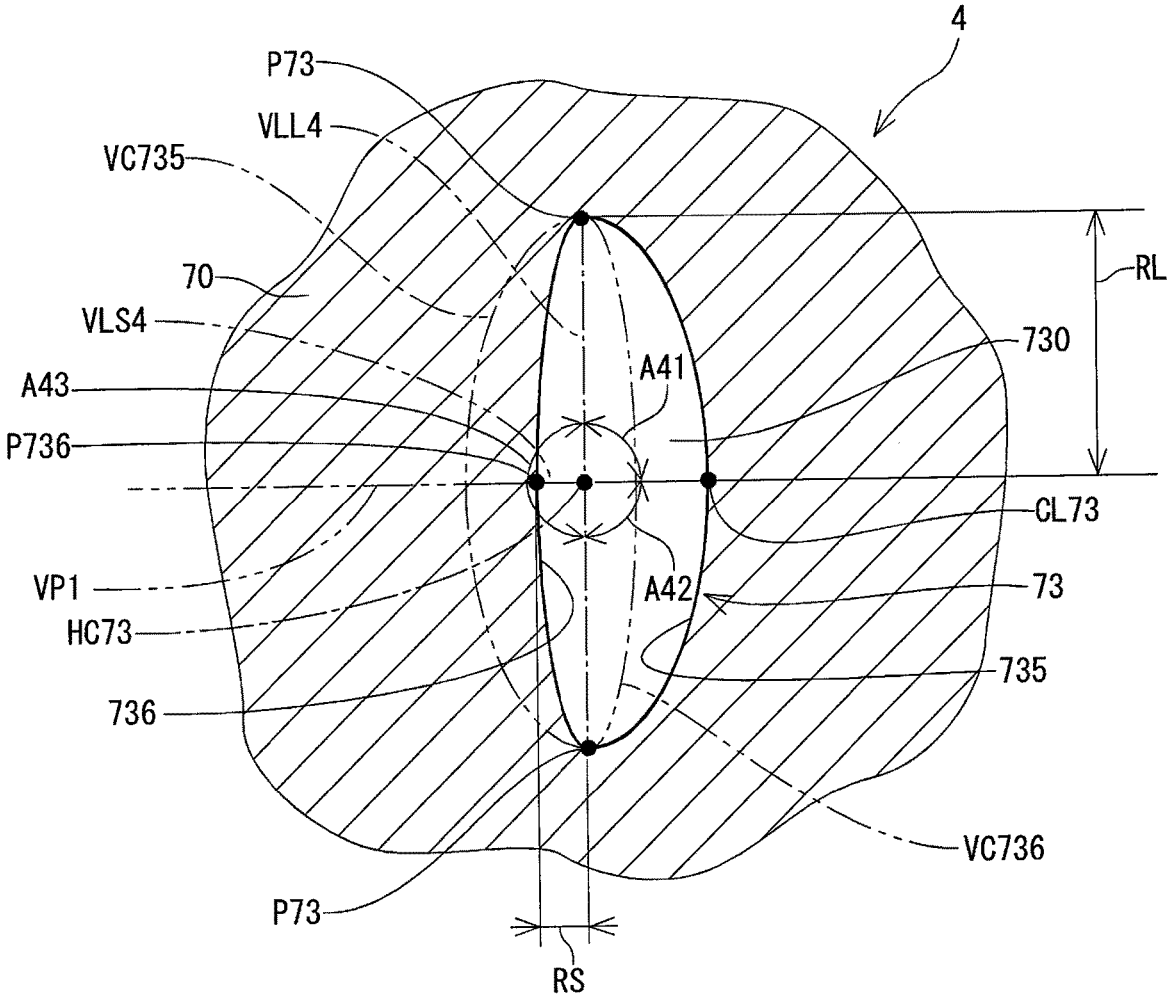
Figure 15:
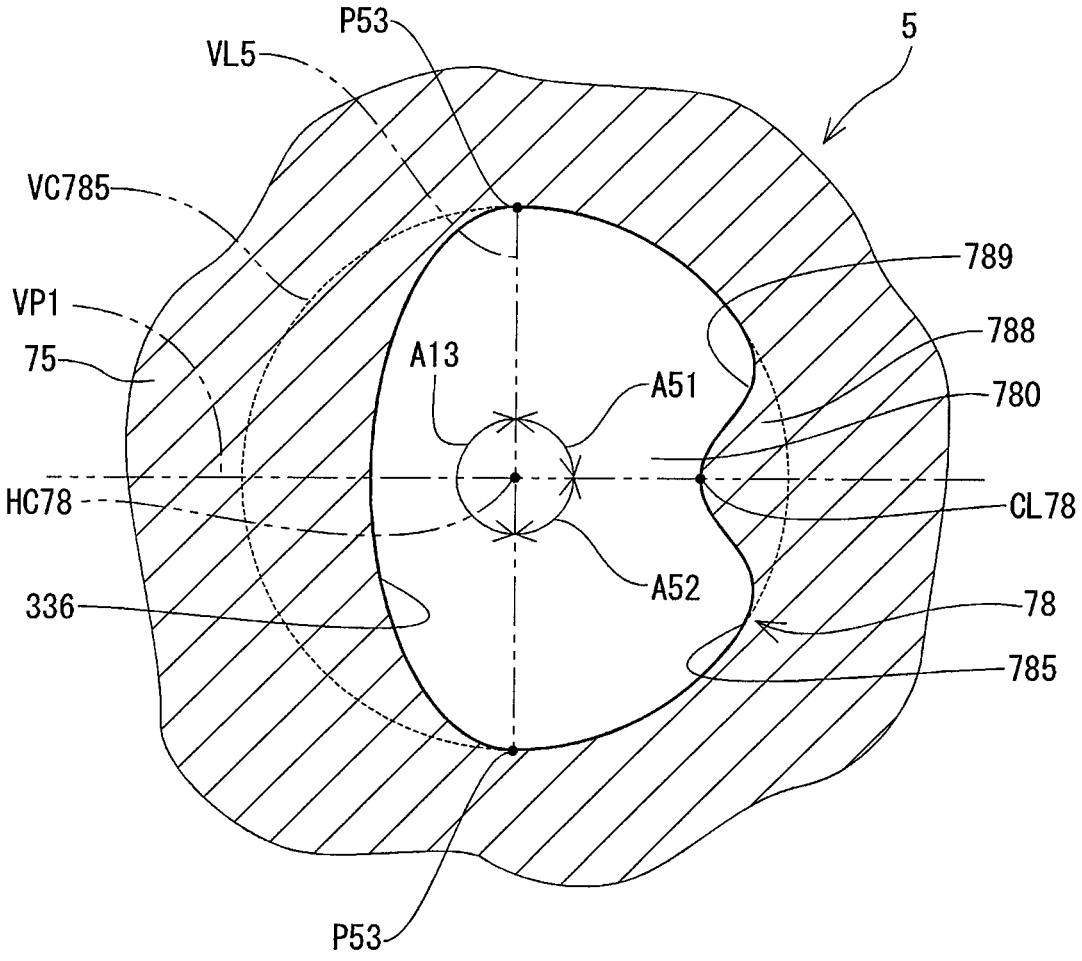
Figure 16:
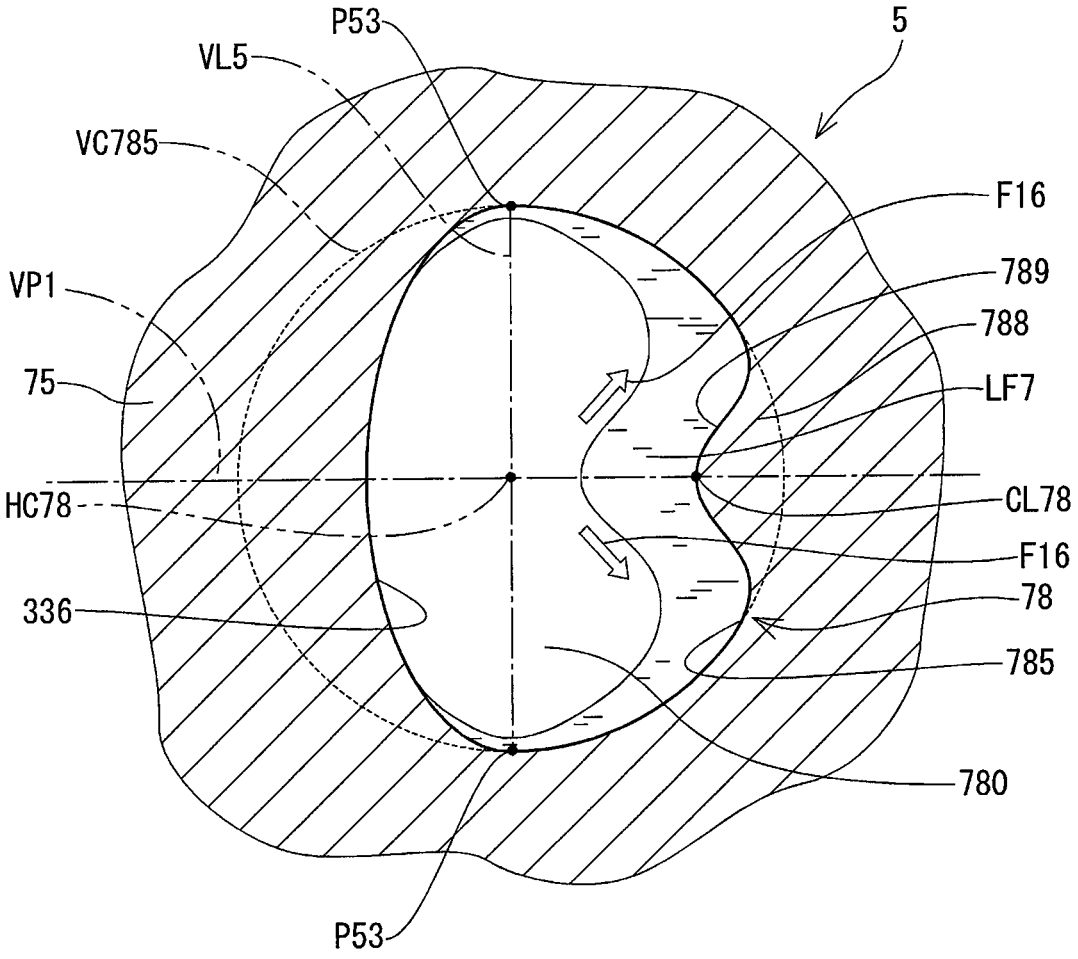
Figure 17:
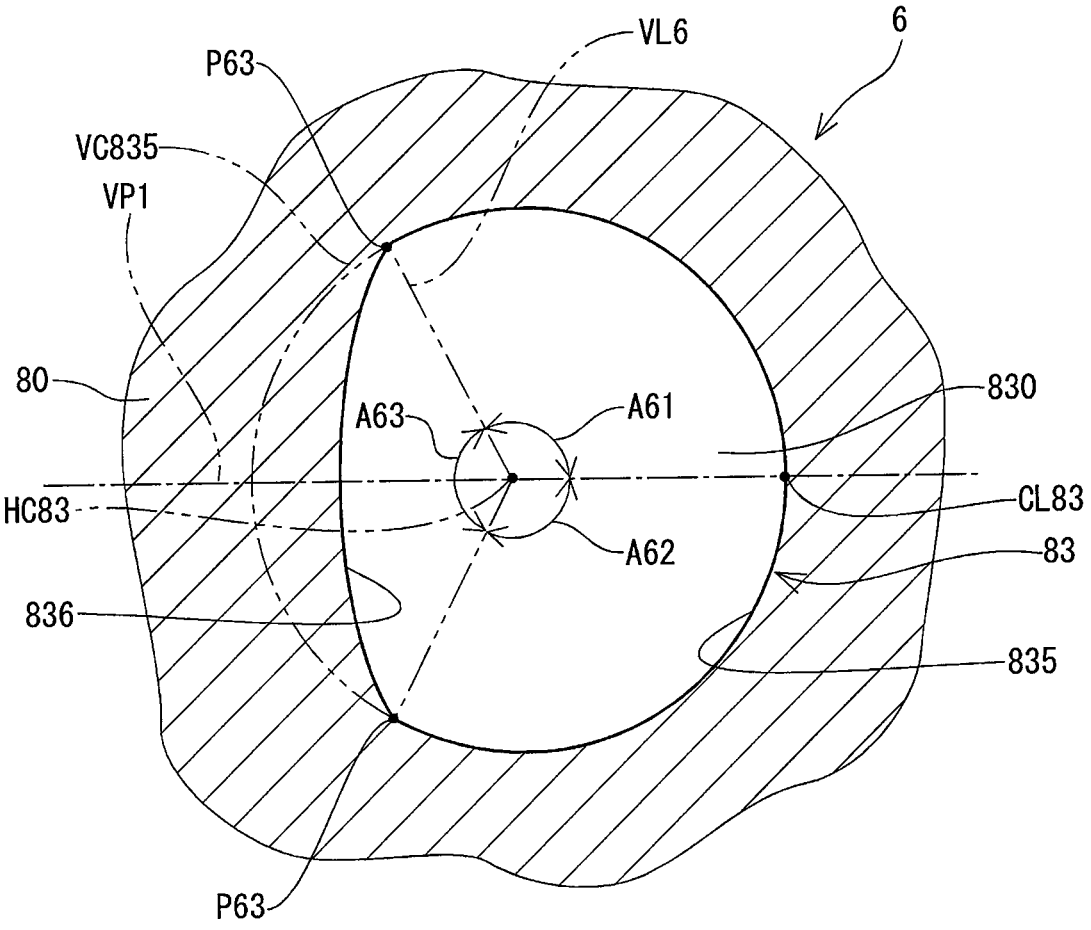
Figure 18:
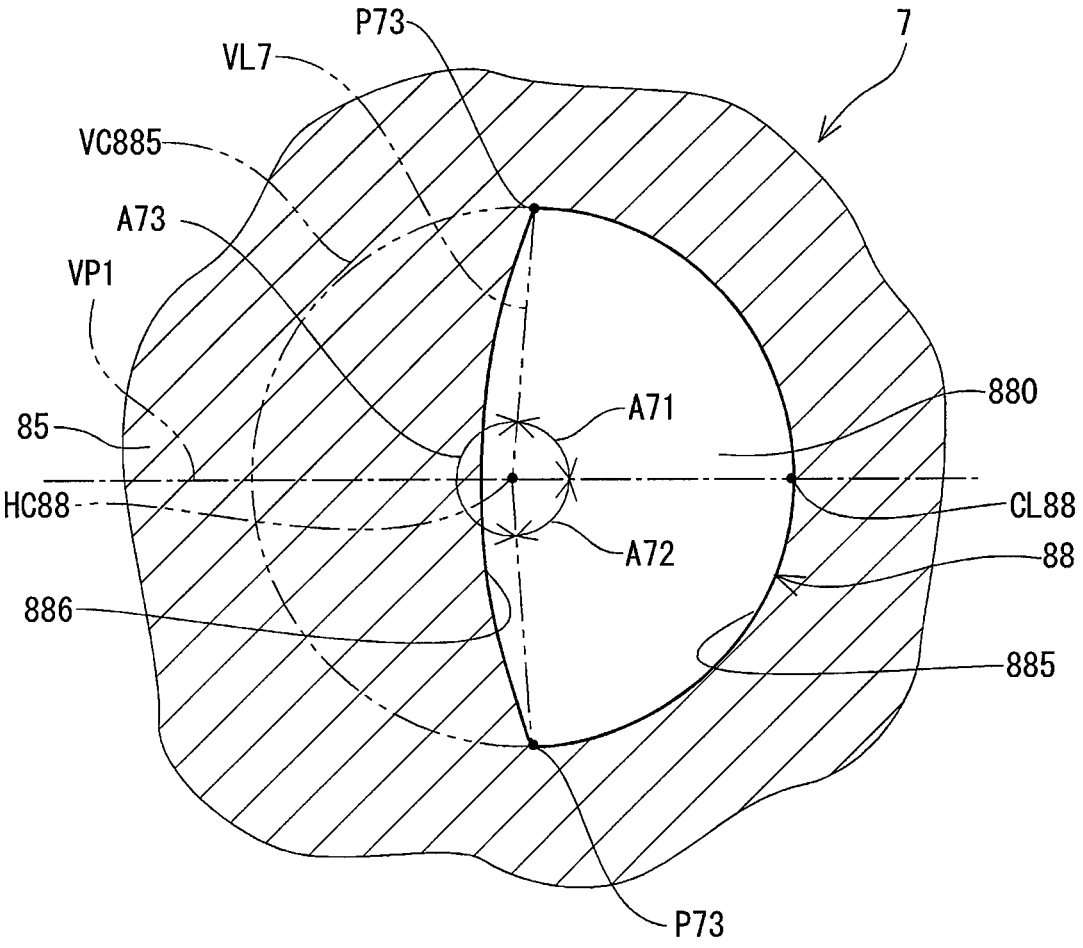

(a) and (b) of FIG. 7 are schematic views illustrating the effect of the fuel injection valve according to the first embodiment of the present disclosure;

FIG. 8 is a characteristic diagram illustrating the effect of the fuel injection valve according to the first embodiment of the present disclosure;

FIG. 9 is a cross-sectional view of an injection hole of a fuel injection valve according to a second embodiment of the present disclosure;

FIG. 10 is an enlarged view of a part X in FIG. 9;

FIG. 11 is a characteristic diagram illustrating the effect of the fuel injection valve according to the second embodiment of the present disclosure;

FIG. 12 is a cross-sectional view of an injection hole of a fuel injection valve according to a third embodiment of the present disclosure;

FIG. 13 is a characteristic diagram illustrating the effect of the fuel injection valve according to the third embodiment of the present disclosure;

FIG. 14 is a cross-sectional view of an injection hole of a fuel injection valve according to a fourth embodiment of the present disclosure;

FIG. 15 is a cross-sectional view of an injection hole of a fuel injection valve according to a fifth embodiment of the present disclosure;

FIG. 16 is a schematic view illustrating the effect of the fuel injection valve according to the fifth embodiment of the present disclosure;

FIG. 17 is a cross-sectional view of an injection hole of a fuel injection valve according to a sixth embodiment of the present disclosure; and FIG. 18 is a cross-sectional view of an injection hole of a fuel injection valve according to a seventh embodiment of the present disclosure.

DESCRIPTION OF EMBODIMENTS

Hereinafter, embodiments of the present disclosure will be described with reference to drawings.

First Embodiment

Figure 1:
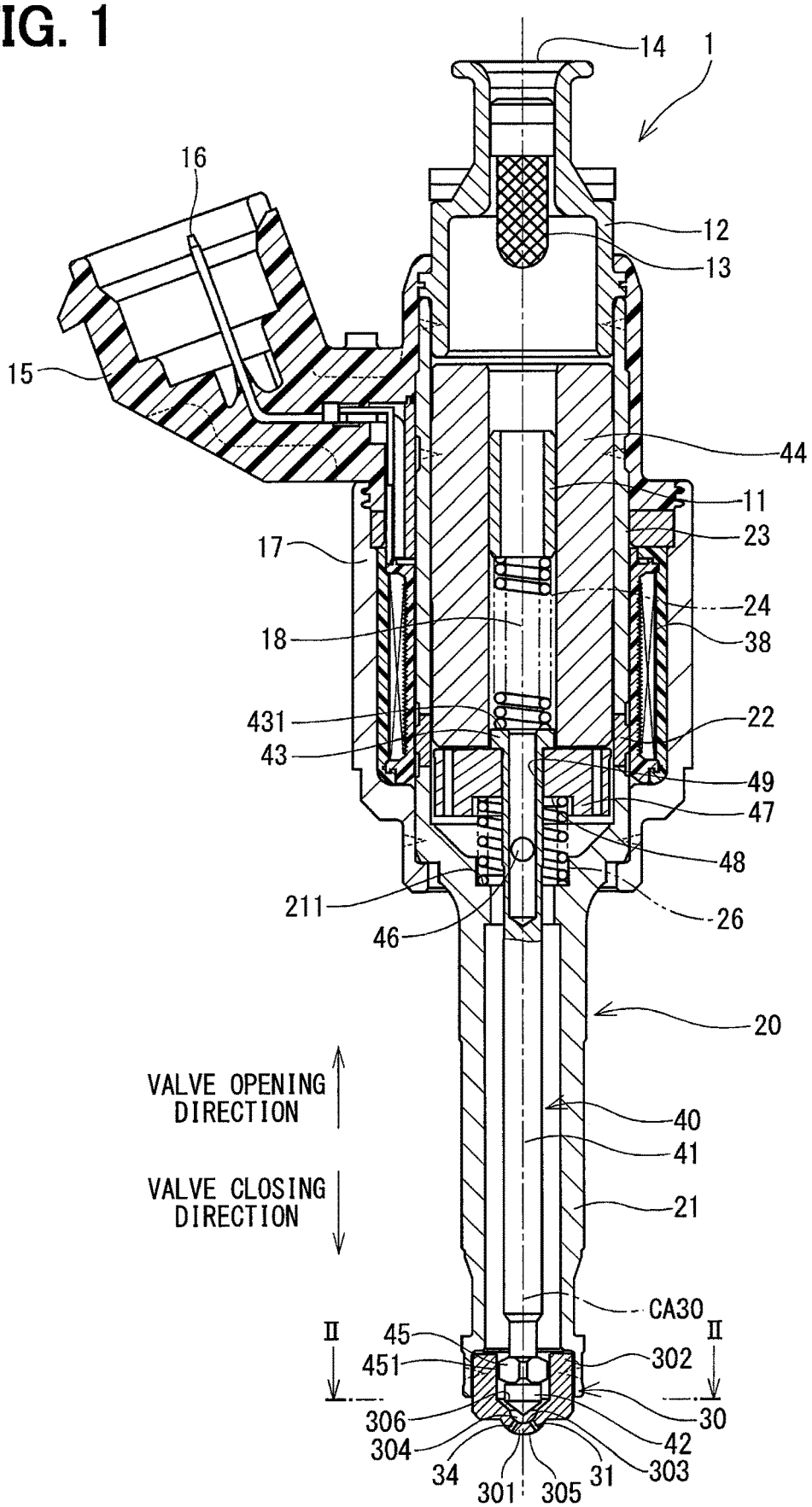
FIG. 1 is a cross-sectional view of a fuel injection valve according to a first embodiment of the present disclosure.

A fuel injection valve according to a first embodiment of the present disclosure will be described with reference to FIGS. 1 to 8. FIG. 1 is a cross-sectional view of a fuel injection valve 1 according to the first embodiment. FIG. 1 shows a valve closing direction and a valve opening direction. In the valve closing direction, a needle 40 moves so as to abut against a valve seat 306 along a center axis CA30 of an injection nozzle 30 of a nozzle body 20. In the valve opening direction, the needle 40 moves so as to be lifted from the valve seat 306.

A fuel injection valve 1 is used in, for example, a fuel injection device for a direct injection engine not shown and injects a gasoline as a fuel into the direct injection engine. The fuel injection valve 1 includes a nozzle body 20, a needle 40, a movable core 47, a fixed core 44, a coil 38, springs 24, 26, and the like. The movable core 47, the stationary core 44, and the coil 38 correspond to a "drive unit" as recited.

The nozzle body 20 includes a first cylinder member 21, a second cylinder member 22, a third cylinder member 23, and an injection nozzle 30. Each of the first cylinder member 21, the second cylinder member 22, and the third cylinder member 23 is a substantially cylindrical member, and the first cylinder member 21, the second cylinder member 22, and the third cylinder member 23 are coaxially located in a predetermined order and are connected to each other.

The injection nozzle 30 is located on an end portion of the first cylinder member 21 on a side opposite to the second cylinder member 22. The injection nozzle 30 is a bottomed cylindrical member and welded to the first cylinder member 21. The injection nozzle 30 is subjected to a quenching treatment so as to exhibit a predetermined hardness. The injection nozzle 30 includes an injection portion 301 and a cylinder portion 302.

Figure 2:
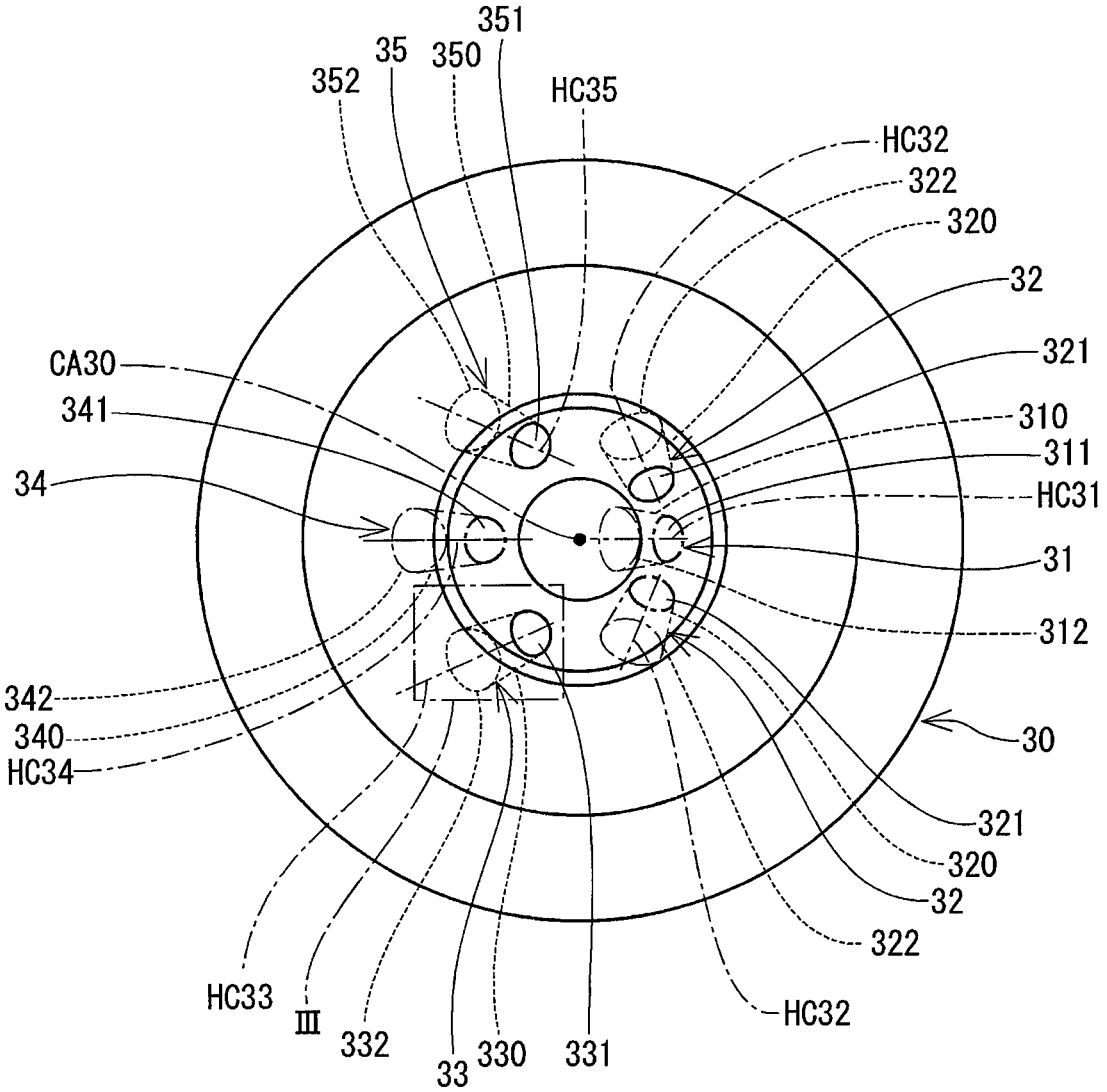
FIG. 2 is a cross-sectional view taken along a line II-II in FIG. 1.

The injection portion 301 is a hollow hemispherical portion centered on a point on the center axis CA30 of the injection nozzle 30. An inner wall surface 303 of the injection portion 301 is formed in a spherical shape. The inner wall surface 303 forms a sack 304 in which the fuel to be injected from the injection hole temporarily stagnates. An outer wall surface 305 of the injection portion 301 protrudes in a direction along the center axis CA30. The injection portion 301 has multiple injection holes for communicating an inside and an outside of the nozzle body 20 with each other. In the present embodiment, as shown in FIG. 2, six injection holes 31, 32, 33, 34, 35, and 36 are arranged in a circumferential direction.

The injection holes 31, 32, 33, 34, 35, and 36 have injection hole axes HC31, HC32, HC33, HC34, HC35, and HC36, respectively. Each of the injection hole axes HC31, HC32, HC33, HC34, HC35, and HC36 is set in the same direction as the direction in which a machining tool for machining the injection holes is advanced when machining the injection hole. The injection hole 31 has an inner opening 311 that is an opening on the inner wall surface 303, an outer opening 312 that is an opening on the outer wall surface 305, an injection hole passage 310 that communicates the inner opening 311 with the outer opening 312, and the like. A cross section of the injection hole 31 perpendicular to the injection hole axis HO 31 is curved. The injection hole 32 has an inner opening 321 that is an opening on the inner wall surface 303, an outer opening 322 that is an opening on the outer wall surface 305, an injection hole passage 320 that communicates the inner opening 321 with the outer opening 322, and the like. A cross section of the injection hole 32 perpendicular to the injection hole axis HO 32 is curved. The injection hole 33 has an inner opening 331 that is an opening on the inner wall surface 303, an outer opening 332 that is an opening on the outer wall surface 305, an injection hole passage 330 that communicates the inner opening 331 with the outer opening 332, and the like. A cross section of the injection hole 33 perpendicular to the injection hole axis HO 33 is curved. The injection hole 34 has an inner opening 341 that is an opening on the inner wall surface 303, an outer opening 342 that is an opening on the outer wall surface 305, an injection hole passage 340 that communicates the inner opening 341 with the outer opening 342, and the like. A cross section of the injection hole 34 perpendicular to the injection hole axis HO 34 is curved. The injection hole 35 has an inner opening 351 that is an opening on the inner wall surface 303, an outer opening 352 that is an opening on the outer wall surface 305, an injection hole passage 350 that communicates the inner opening 351 with the outer opening 352, and the like. A cross section of the injection hole 35 perpendicular to the injection hole axis HO 35 is curved. The injection hole 36 has an inner opening 361 that is an opening on the inner wall surface 303, an outer opening 362 that is an opening on the outer wall surface 305, an injection hole passage 360 that communicates the inner opening 361 with the outer opening 362, and the like. A cross section of the injection hole 36 perpendicular to the injection hole axis HO 36 is curved. An annular valve seat 306 against which the needle 40 is configured to abut is formed on the inner wall surface 303. The detailed shape of the injection hole will be described later.

The cylinder portion 302 surrounds a radially outer side of the injection portion 301, and extends in a direction opposite to a direction in which the outer wall surface 305 of the injection portion 301 protrudes. The other end portion of the cylinder portion 302 is connected to the first cylinder member 21.

The needle 40 is housed in the nozzle body 20 and is movable back and forth. The needle 40 includes a shaft portion 41, a seal portion 42, a large diameter portion 43, and the like.

The shaft portion 41 is a cylindrical rod-shaped portion. A sliding portion 45 is located between the shaft portion 41 and the seal portion 42. The sliding portion 45 is a substantially cylindrical portion, and a part of an outer wall 451 is chamfered. A non-chamfered portion of the outer wall 451 in the sliding portion 45 is slidable on an inner wall of the injection nozzle 30. With the above configuration, a reciprocating movement of the needle 40 on a tip portion on the valve seat 306 side is guided. The shaft portion 41 has a hole 46 for connecting an inner wall and an outer wall of the shaft portion 41 on an end portion opposite to a side where the sliding portion 45 is provided.

The seal portion 42 is located on an end portion of the shaft portion 41 on the valve seat 306 side to be abuttable against the valve seat 306. When the seal portion 42 abuts against the valve seat 306, a flow of fuel between an inside and an outside of the nozzle body 20 through the injection holes 31, 32, 33, 34, 35, and 36 is restricted. Further, when the seal portion 42 is lifted from the valve seat 306, the flow of fuel between the inside and the outside of the nozzle body 20 through the injection holes 31, 32, 33, 34, 35, and 36 is permitted.

The large diameter portion 43 is located on a side of the shaft portion 41 opposite to the seal portion 42. The large diameter portion 43 is larger in outer diameter than the shaft portion 41. An end face of the large diameter portion 43 on the valve seat 306 side is abuttable against the movable core 47.

The needle 40 includes a sliding portion 45 that slides on the inner wall of the injection nozzle 30 and a shaft portion 41 that is supported by an inner wall of the second cylinder member 22 through the movable core 47. With the above configuration, the reciprocating movement of the needle 40 in the nozzle body 20 is guided.

The movable core 47 is a substantially cylindrical member that has been subjected to a magnetically stabilizing process. The movable core 47 is located on the injection nozzle 30 side of the large diameter portion 43 in a reciprocatable manner. The movable core 47 has a through hole 49 substantially in the center of the movable core 47. The shaft portion 41 of the needle 40 is inserted through the through hole 49.

The stationary core 44 is a substantially cylindrical member that has been subjected to a magnetically stabilizing process. The stationary core 44 is welded to the third cylinder member 23 of the nozzle body 20 and fixed to an inside of the nozzle body 20.

The coil 38 is a substantially cylindrical member and located to surround mainly radially outer sides of the second cylinder member 22 and the third cylinder member 23. The coil 38 develops a magnetic field upon receiving an electric power, and forms a magnetic circuit passing through the stationary core 44, the movable core 47, the first cylinder member 21, and the third cylinder member 23. With the above configuration, a magnetic attraction force is generated between the stationary core 44 and the movable core 47, and the movable core 47 is attracted to the stationary core 44.

The spring 24 is located such that one end of the spring 24 abuts against a spring abutment surface 431 of the large diameter portion 43. The other end of the spring 24 abuts against one end of an adjusting pipe 11 that is press-fitted into an inside of the stationary core 44. The spring 24 has a force extending in the axial direction. With the above configuration, the spring 24 urges the needle 40 in a direction of the valve seat 306, that is, in the valve closing direction together with the movable core 47.

The spring 26 is located such that one end of the spring 26 abuts against an end face 48 of the movable core 47 on the injection nozzle 30 side. The other end of the spring 26 abuts against an annular step surface 211 of the first cylinder member 21. The spring 26 exhibits a force to extend the spring 26 in the axial direction. With the above configuration, the spring 26 urges the movable core 47 in a direction opposite to the valve seat 306, that is, in the valve opening direction. In the present embodiment, an urging force of the spring 24 is set to be larger than an urging force of the spring 26. With the above configuration, in a state where no electric power is supplied to the coil 38, the seal portion 42 is in a state to abut against the valve seat 306, that is, in the valve close state.

A substantially cylindrical fuel introduction pipe 12 is fitted into and welded to an end portion of the third cylinder member 23 opposite to the second cylinder member 22. A filter 13 is located inside the fuel introduction pipe 12. The filter 13 collects foreign matter contained in the fuel that flows from an introduction port 14 of the fuel introduction pipe 12.

Radially outer sides of the fuel introduction pipe 12 and the third cylinder member 23 are molded with a resin. A connector 15 is provided at the mold part. A terminal 16 for supplying the electric power to the coil 38 is insert-molded into the connector 15. In addition, a cylindrical holder 17 is located on a radially outer side of the coil 38 so as to cover the coil 38.

The fuel flowing from the introduction port 14 of the fuel introduction pipe 12 flows in a radially inward direction of the stationary core 44, an inside of the adjusting pipe 11, the inside of the large diameter portion 43 and the shaft portion 41 of the needle 40, the hole 46, and a gap between the first cylinder member 21 and the shaft portion 41 of the needle 40, and is guided into the inside of the injection nozzle 30. In other words, a portion extending from the introduction port 14 of the fuel introduction pipe 12 to the gap between the first cylinder member 21 and the shaft portion 41 of the needle 40 serves as a fuel passage 18 for introducing the fuel into the injection nozzle 30.

Figure 3:
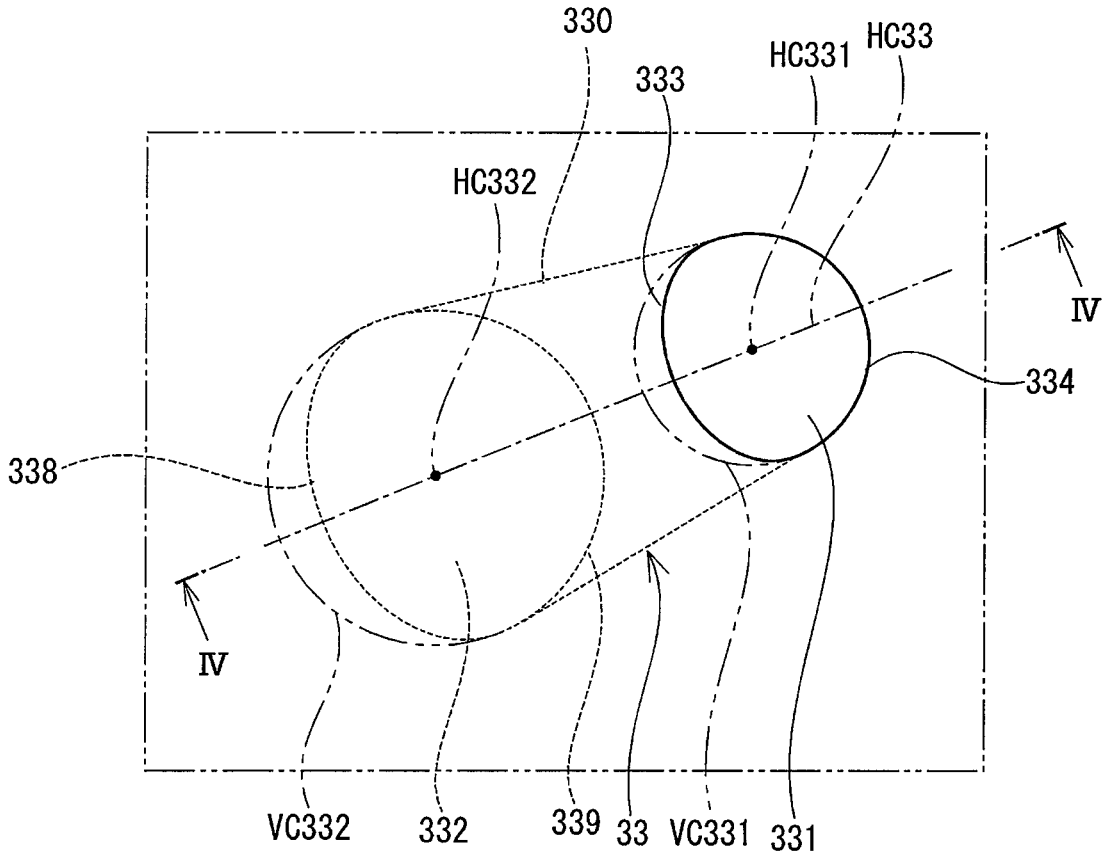
FIG. 3 is an enlarged view of a part III in FIG. 2.
Figure 4:
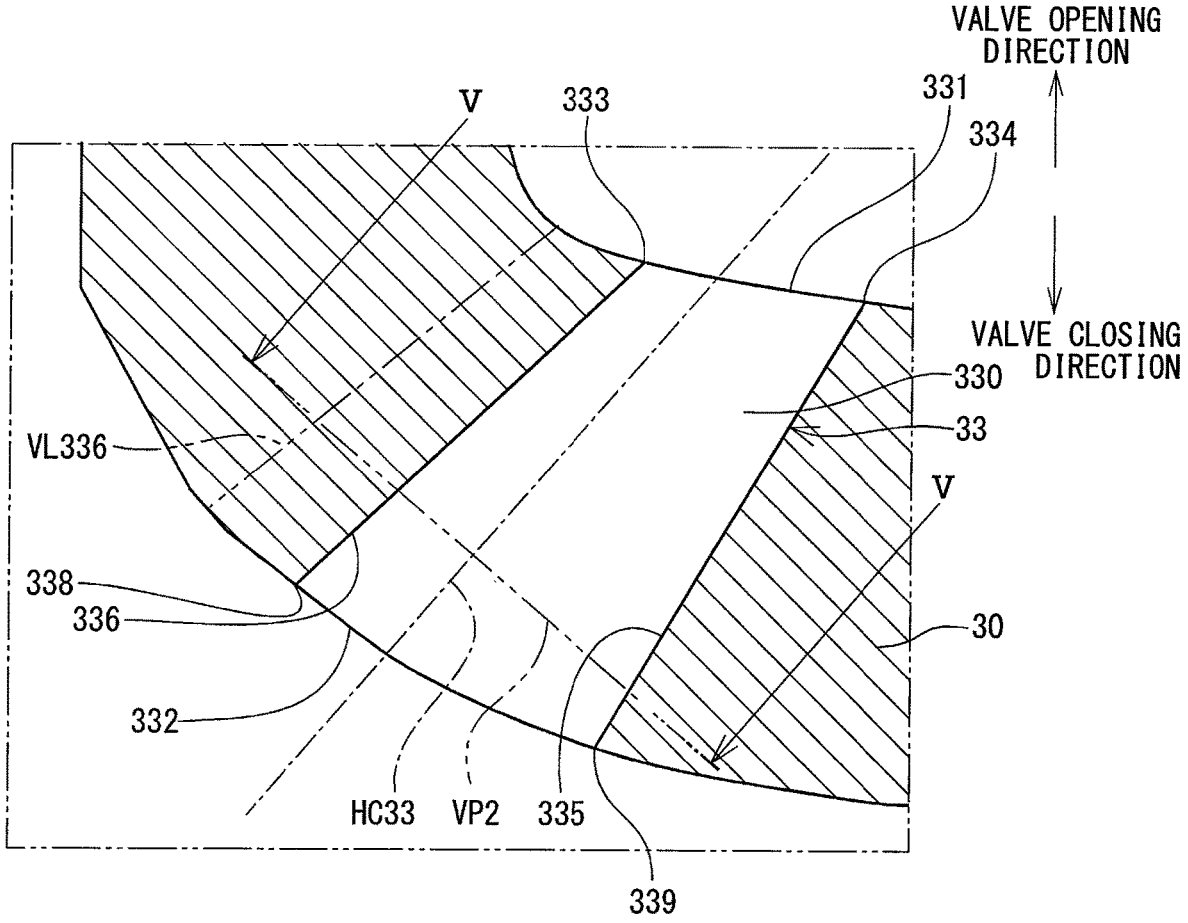
FIG. 4 is a cross-sectional view taken along a line IV-IV in FIG. 3.
Figure 5:
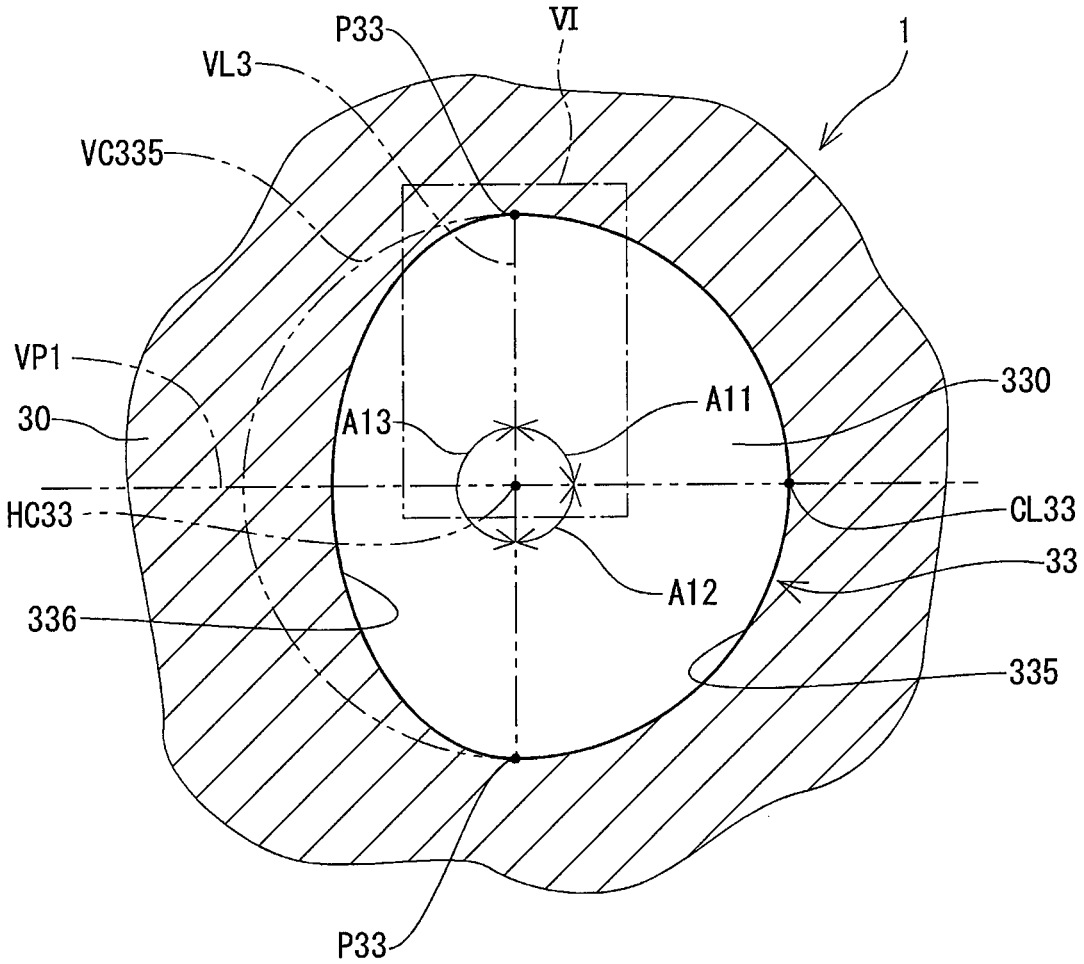
FIG. 5 is a cross-sectional view taken along a line V-V in FIG. 4.

The fuel injection valve 1 according to the present embodiment has the injection hole in a specific shape. In the present embodiment, the shape of the injection hole 33 will be described with reference to FIGS. 3 to 6. FIG. 3 is a schematic view of the injection hole 33 as viewed from the inside of the nozzle body 20. FIG. 4 shows a cross section taken along the first virtual plane VP1 which is parallel to the center axis CA30 and which is a plane including the injection hole axis HC33 of the injection nozzle 30. FIG. 4 shows the valve closing direction and the valve opening direction shown in FIG. 1. In addition, FIG. 5 shows a cross section taken along a second virtual plane VP2 perpendicular to the injection hole axis HC33 of the injection hole 33. In this example, only the shape of the injection hole 33 will be described, but the other injection holes 31, 32, 34, 35, and 36 of the fuel injection valve 1 also have the same features.

As shown in FIG. 3, a cross-sectional area of the inner opening 331 is smaller than a cross-sectional area of the outer opening 332. The inner opening 331 has a cross-sectional shape different from a true circle. Specifically, when compared with a virtual circle VC331 centered on a point HC 331 on the injection hole axis HC33 as a reference, one edge 333 of edges forming the inner opening 331 is located closer to a point HC331 than the other edge 334. In addition, the outer opening 332 has a cross-sectional shape different from a true circle. Specifically, when compared with a virtual circle VC332 centered on a point HC 332 on the injection hole axis HC33 as a reference, one edge 338 of edges forming the outer opening 332 is located closer to a point HC332 than the other edge 339.

The shape of the two openings of the injection hole 33 will be described in more detail based on the shape of the injection hole passage 330 communicating the inner opening 311 with the outer opening 312 with reference to FIGS. 4 to 6.

In the present embodiment, the injection hole passage 330 is formed of a first inner wall 335 and a second inner wall 336. A cross section of the first inner wall 335 shown in FIG. 4 is located on the valve closing direction side relative to the injection hole axis HC 33 shown in FIG. 4. Further, a cross section of the second inner wall 336 shown in FIG. 4 is located on the valve opening direction side as "a side opposite to the valve closing direction side" relative to the injection hole axis HC33 shown in FIG. 4. FIG. 4 shows a virtual line VL336 that is at the same distance as a distance from the injection hole axis HC33 to the first inner wall 335 on the valve opening direction side relative to the injection hole axis HC33. The virtual line VL336 is also a line that connects the virtual circle VC331 with the virtual circle VC332 in FIG. 3 in a direction along the injection hole axis HC33.

Further, as shown in FIG. 5, a cross section of the first inner wall 335 taken along the second virtual plane VP2, which is also a cross section of the injection hole 33, is formed in a circular arc shape of a virtual circle VC335 centered on a point on the injection hole axis HC33. In other words, the injection hole axis HC33 is also a line connecting the center of the virtual circle VC 335 including the cross section of the first inner wall 335 taken along the second virtual plane VP2 as a part of the circumference.

In the present embodiment, when an intersection line between the first virtual plane VP1 and the first inner wall 335 is taken as the first intersection line CL33, a cross section of the first inner wall 335 taken along the second virtual plane VP2 as shown in FIG. 5 is formed so as to define a central angle of 90 degrees in each of the two circumferential directions from the point on the first intersection line CL33 when viewed from the point on the injection hole axis HC33 (angles A11 and A12 shown in FIG. 5). In other words, the first inner wall 335 is formed so that the cross section taken along the second virtual plane VP2 is plane symmetrical with respect to the first virtual plane VP1 as a plane of symmetry. In FIG. 5, for convenience, a virtual line VL3 that connects a connection point P33 between the first inner wall 335 and the second inner wall 336 with a point on the injection hole axis HC33 is shown.

In addition, the cross section of the second inner wall 336 taken along the second virtual plane VP2 is located closer to the injection hole axis HC33 than the cross section of the first inner wall 335. In the present embodiment, the second inner wall 336 is shaped to collapse toward the injection hole axis HC33 side as compared with the cross section of the first inner wall 335 taken along the second virtual plane VP2. In the present embodiment, the cross section of the second inner wall 336 taken along the second virtual plane VP2 is formed so as to define a central angle of 180 degrees as viewed from the point on the injection hole axis HC 33 (an angle A13 shown in FIG. 5). As a result, the second inner wall 336 is formed such that the cross section taken along the second virtual plane VP2 is plane-symmetrical with respect to the first virtual plane VP1 as a plane of symmetry.

Figure 6:
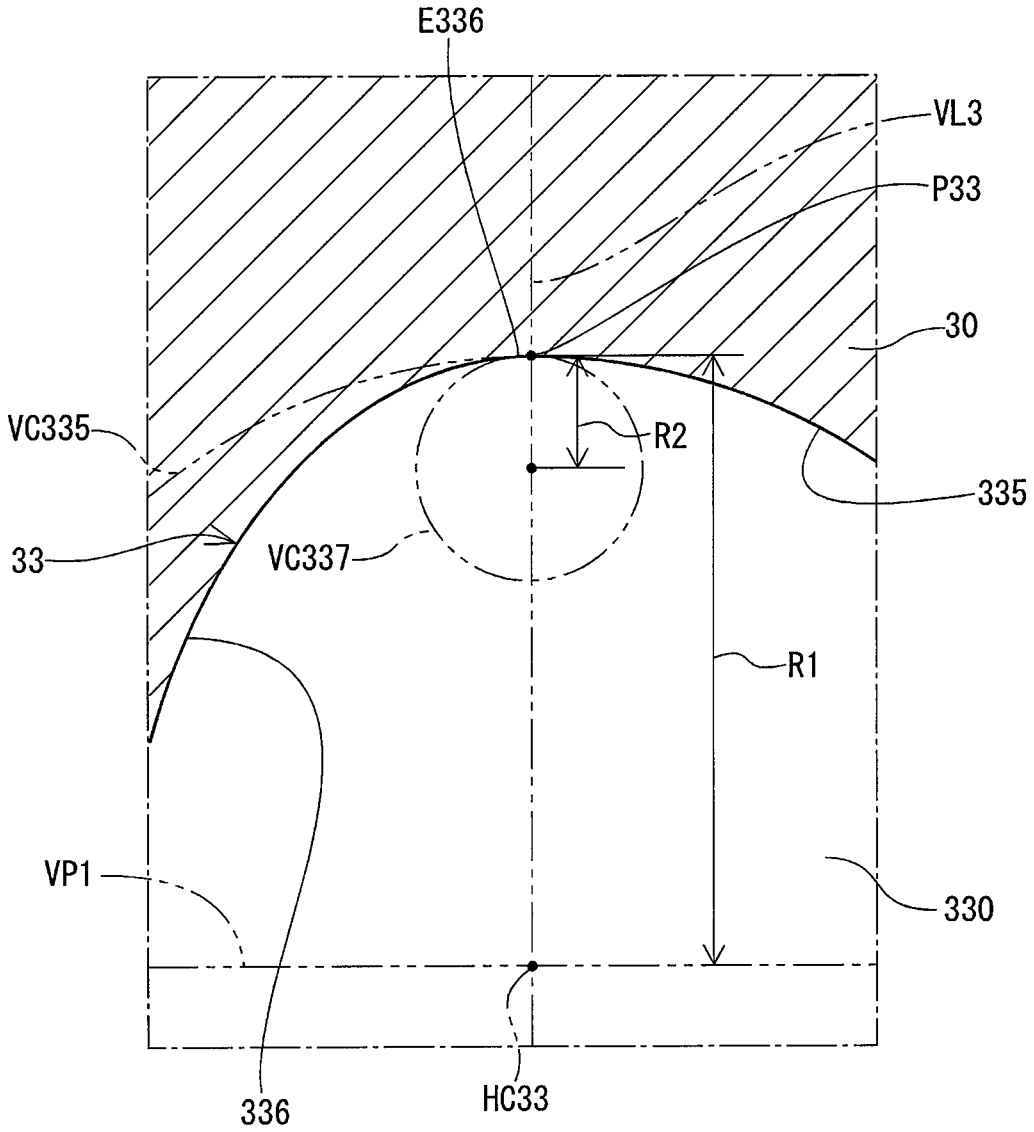
FIG. 6 is an enlarged view of a part VI in FIG. 5.

An end portion E336 of the second inner wall 336 connected to the first inner wall 335 is formed to be smoothly connected to the first inner wall 335 as shown in FIG. 6. As a result, the inner wall forming the injection hole passage 330 is curved. In the present embodiment, when a radius of a virtual circle VC337 including a cross section of an end E336 of the second inner wall 336 as a part of a circular arc is defined as a radius R2, and a radius of the virtual circle VC335 including a cross section of the first inner wall 335 as a part of the circular arc is defined as a radius R1, an end portion E336 of the second inner wall 336 is formed such that R2/R1 is equal to or less than 0.2.

(1) Next, the operation of the fuel injection valve 1 according to the present embodiment will be described with reference to (a) and (b) in FIG. 7.

In FIG. 7, (a) is a cross-sectional view perpendicular to the injection hole axis HC33 of the injection hole 33 and shows a cross section. Further, in FIG. 7, (b) is a cross-sectional view perpendicular to an injection hole axis HC93 of an injection hole 93 of the fuel injection valve 9 as a comparative example and shows a cross section. In the fuel injection valve 9 of the comparative example, the cross section of the injection hole 93 is formed in a true circle centering on a point on the injection hole axis HC93.

In the fuel injection valve 9 of the comparative example, when the needle is lifted from the valve seat, the fuel in the nozzle body flows into the injection hole 93. The fuel flowing into the injection hole 93 forms a liquid film LF9 on the inner wall of the injection hole forming an injection hole passage 930 of the injection hole 93. In this example, the injection hole inner wall on one side where the relatively thick liquid film LF 9 of the fuel is formed as viewed along the injection hole axis HC93 is defined as an injection hole inner wall 935, and an injection hole inner hole located on a side opposite to the injection hole inner wall 935 across the injection hole axis HC93 is defined as an injection hole inner wall 936. In the fuel injection valve 9 of the comparative example, since the cross section of the injection hole 93 is formed in a true circle centered on a point on the injection hole axis HC93, as shown in (b) in FIG. 7, a part of the liquid film LF9 of the fuel on the hole inner wall 935 is likely to move in a circumferential direction of the injection hole passage 930. For that reason, the liquid film LF9 of the fuel is also likely to be formed on the injection hole inner wall 936. When a spread degree Dsp of the liquid film LF 9 of the fuel is defined as a ratio of a total of lengths L961 and L962 of the liquid film LF9 of the fuel on the injection hole inner wall 936 to a length L95 of the liquid film LF9 of the fuel on the nozzle hole inner wall 935, the spread degree Dsp will be a relatively large value in the fuel injection valve 9.

On the other hand, in the fuel injection valve 1, the first inner wall 335, on which the relatively thick liquid film LF3 of the fuel is formed as viewed along the injection hole axis HC33, is formed in a circular arc shape having a cross section in a true circle. On the other hand, the second inner wall 336 is formed so that the cross section of the second inner wall 336 is located closer to the injection hole axis HC33 than the cross section of the first inner wall 335. As a result, as shown in (a) in FIG. 7, the liquid film LF3 of the fuel formed on the first inner wall 335 becomes relatively unlikely to move on the second inner wall 336. As a result, the total of the lengths L361 and L362 of the liquid film LF3 of the fuel on the second inner wall 336 is shorter than that of the fuel injection valve 9 in the comparative example. In other words, the spread degree Dsp of the liquid film of the fuel, which is a ratio of a total of lengths L361 and L362 of the liquid film LF3 of the fuel on the second inner wall 336 to a length L35 of the liquid film LF3 of the fuel on the first inner wall 335, is smaller than that of the fuel injection valve 9.

In this manner, in the fuel injection valve 1, the spread of the liquid film of the fuel in the second inner wall 336 can be reduced as compared with the injection hole whose cross-sectional shape is a true circle. As a result, the spread of the liquid film of the fuel in the injection hole passages 310, 320, 330, 340, 350, and 360 can be restricted from being greatly varied every time the fuel injection is performed by the fuel injection valve 1. Therefore, the fuel injection valve 1 can reduce a range of the spread of the fuel after spraying and a variation in the spray shape depending on the spread degree of the liquid film of the fuel. Thus, the stability of the spray characteristics of the fuel can be improved.

(2) In the fuel injection valve 1, the cross sections of the first inner walls of the injection holes 31, 32, 33, 34, 35, and 36 on the respective second virtual planes are formed so as to define a central angle of 180 degrees as viewed from points on the injection hole axes HC31, HC32, HC33, HC34, HC35, and HC36. As a result, as compared with a case in which the cross section of the second inner wall taken along the second virtual plane defines the central angle of 180 degrees or more as viewed along the injection hole axis, the liquid films of the fuel formed on the injection hole passages 310, 320, 330, 340, 350, and 360 can be formed relatively widely. Therefore, the fuel injection valve 1 can bring a large amount of fuel into fine particles.

(3) In the fuel injection valve 1, the cross sections of the first inner walls of the injection holes 31, 32, 33, 34, 35, and 36 on the respective second virtual planes are formed in a circular arc shape centered on the points on the injection hole axes HC31, HC32, HC33, HC34, HC35, and HC36. This enables to relatively easily machine the injection holes 31, 32, 33, 34, 35, and 36.

(4) In addition, the present applicant has conducted experiments on a relationship between a shape of the end portion E336 of the second inner wall 336 and the spread degree Dsp of the fuel. The results are shown in FIG. 8. In FIG. 8, an axis of abscissa represents a ratio of the radius R2 of the virtual circle VC337 to the radius R1 of the virtual circle VC335, and an axis of ordinate represents the spread degree Dsp of the fuel.

As shown in FIG. 8, it has been proved that as the ratio of the radius R2 to the radius R1 increases more, the spread degree Dsp of the fuel increases more. As an indication that an influence of a shape change in the injection hole becomes relatively small, the spread degree Dsp of the fuel in the injection hole passage may be set to 0.2. From the experimental results shown in FIG. 8, it has been proved that if the ratio of the radius R2 to the radius R1 is set to be equal to or less than 0.2, the spread degree Dsp of the fuel can be set to 0.2.

In the present embodiment, as described above, the injection holes 31, 32, 33, 34, 35, and 36 are formed so that the ratio of the radius R2 to the radius R1 is set to be equal to or less than 0.2. As a result, the liquid film of the fuel formed in the injection hole passages 310, 320, 330, 340, 350, and 360 becomes relatively unlikely to spread along the second inner wall 336. As a result, the fuel injection valve 1 can further improve the stability of the fuel spray characteristics.

(5) In the fuel injection valve 1, the injection holes 31, 32, 33, 34, 35, and 36 are provided so that the first inner wall and the second inner wall are smoothly connected to each other (refer to FIG. 6). As a result, the cross section of the injection hole passages 310, 320, 330, 340, 350, and 360 taken along the second virtual plane is curved. Therefore, the fuel injection valve 1 can restrict turbulence of the fuel flow at a corner from occurring.

(6) In the fuel injection valve 1, the cross sections of the injection holes 31, 32, 33, 34, 35, and 36 on the respective second virtual planes are plane symmetrical with respect to the first virtual planes including the injection hole axes HC31, HC32, HC33, HC34, HC35, and HC36 as planes of symmetry. As a result, the liquid film of the fuel can be spread symmetrically with respect to the first virtual plane. Therefore, the fuel injection valve 1 can evenly inject the fuel in the direction of the fuel injected from the injection holes 31, 32, 33, 34, 35, and 36.

Second Embodiment

Next, a fuel injection valve according to a second embodiment of the present disclosure will be described with reference to FIGS. 9 to 11. The second embodiment is different from the first embodiment in a relationship of the shape of the injection hole. The substantially same portions as those in the first embodiment are denoted by the same reference signs, and a repetitive description will be omitted.

FIGS. 9 and 10 show cross-sectional views of an injection nozzle 50 of a fuel injection valve 2 according to a second embodiment. FIG. 9 shows a cross section of an injection hole 53 of an injection nozzle 50 on a second virtual plane perpendicular to an injection hole axis HC53. The injection hole axis HC53 is a line connecting the center of a virtual circle VC335 including the cross section of a first inner wall 335 taken along the second virtual plane as a part of the circumference. In this example, only the injection hole 53 will be described, but the other injection holes of the fuel injection nozzle 50 also have the same features.

In the present embodiment, an injection hole passage 530 of the injection hole 53 is formed of a first inner wall 335, a second inner wall 536, and a third inner wall 537. The second inner wall 536 is provided on a side opposite to the first inner wall 335 across an injection hole axis HC53. In other words, a cross section of the second inner wall 536 on a first virtual plane VP1 which is a plane including the injection hole axis HC53 and is parallel to a center axis CA30 is located on a valve opening direction side relative to the injection hole axis HC33 on the first virtual plane VP1. The third inner wall 537 is provided between the first inner wall 335 and the second inner wall 536. In FIG. 9, for convenience, a virtual line VL31 that connects a connection point P531 between the first inner wall 335 and the third inner wall 337 and a point on the injection hole axis HC53 is shown. In addition, a virtual line VL32 that connects a connection point P532 between the second inner wall 336 and the third inner wall 337 and a point on the injection hole axis HC53 is shown.

The cross section of the second inner wall 536 shown in FIG. 9 is located closer to the injection hole axis HC53 than the cross section of the first inner wall 335. In the present embodiment, the second inner wall 536 is formed in a circular arc shape of a virtual circle VC 536 having a radius larger than a radius of the virtual circle VC 335. In addition, according to the present embodiment, the cross section of the second inner wall 536 shown in FIG. 9 is formed to define a central angle less than 180 degrees as viewed from the point on the injection hole axis HC 53 (an angle A23 shown in FIG. 9).

The third inner wall 537 is formed so as to smoothly connect the first inner wall 335 to the second inner wall 536 as shown in FIG. 10. As a result, the inner wall forming the injection hole passage 530 is curved. In the present embodiment, when a radius of a virtual circle VC537 including the cross section of the third inner wall 537 as a part of a circular arc is defined as a radius R3, the third inner wall 537 is formed so that R3/R1 is set to be equal to or less than 0.2.

As shown in FIG. 10, a tangent line that comes in contact with the cross section of the first inner wall 335 at the connection point P531 is defined as a first tangent line L531, and a tangent line that comes in contact with the cross section of the second inner wall 536 at the connection point P532 is defined as a second tangent line L532. In the present embodiment, the nozzle hole inner wall of the injection hole 53 is formed so that the first tangent line L531 makes an angle A24 of 40 degrees or more with the second tangent line L532.

The present applicant has conducted experiments on a relationship between the angle A24 and the spread degree Dsp of the fuel. The results are illustrated in FIG. 11. In FIG.

11, an axis of abscissa represents an angle A24 formed between the first tangent line L531 and the second tangent line L532, and an axis of ordinate represents the spread degree Dsp of the fuel. As shown in FIG. 11, it has been proved that as the angle A24 increases more, the spread degree Dsp of the fuel decreases more. From the viewpoint of the above fact, in order to set the spread degree Dsp of the fuel to 0.2 which is the indication that the influence of the shape change in the injection hole becomes relatively small, it is desirable to set the angle A24 to 0.2 or less.

In the present embodiment, the second inner wall 536 is formed so as to be located closer to the injection hole axis HC53 than the first inner wall 335 on which a relatively thick liquid film of the fuel is formed. As a result, the fuel injection valve 2 achieves the same advantages as those in the first embodiment. In addition, in the fuel injection valve 2, the injection hole inner wall of the injection hole 53 is formed so that the first tangent line L531 makes an angle A24 of 40 degrees or more with the second tangent line L532. As a result, the spread degree Dsp of the fuel becomes equal to or less than 0.2, and the fuel is unlikely to spread on the second inner wall 536. Therefore, the fuel injection valve 2 can further improve the stability of the fuel spray characteristics.

Third Embodiment

Next, a fuel injection valve according to a third embodiment of the present disclosure will be described with reference to FIGS. 12 and 13. The third embodiment is different from the first embodiment in a shape of the injection hole. The substantially same portions as those in the first embodiment are denoted by the same reference signs, and a repetitive description will be omitted.

FIG. 12 shows a cross-sectional view of an injection nozzle 60 of a fuel injection valve 3 according to the third embodiment. FIG. 12 shows a cross section of an injection hole 63 of an injection nozzle 60 on a second virtual plane perpendicular to an injection hole axis HC63. The injection hole axis HC63 is a line connecting the center of a virtual circle VC335 including the cross section of a first inner wall 335 taken along the second virtual plane as a part of the circumference. In this example, only the injection hole 63 will be described, but the other injection holes of the fuel injection nozzle 60 also have the same features.

In the present embodiment, an injection hole passage 630 of the injection hole 63 is formed of a first inner wall 335 and a second inner wall 636. The second inner wall 636 is provided on a side opposite to the first inner wall 335 across an injection hole axis HC63. In other words, a cross section of the second inner wall 636 on a first virtual plane VP1 which is a plane including the injection hole axis HC63 and is parallel to a center axis CA30 is located on a valve opening direction side relative to the injection hole axis HC63 on the first virtual plane VP1.

The cross section of the second inner wall 636 shown in FIG. 12 is located closer to the injection hole axis HC63 than the cross section of the first inner wall 335. In this example, in the cross section shown in FIG. 12, a virtual line that connects a connection point P63 between the first inner wall 335 and the second inner wall 636 and a point on the injection hole axis HC63 is defined as a virtual line VLL3. In addition, a virtual line that connects a point P636 on the second inner wall 636 and a point on the injection hole axis HC63, which is a virtual line provided so as to intersect perpendicularly with the virtual line VLL3 and extend in a direction of the second inner wall 636, is defined as a virtual line VLS3. In this case, a cross section of the second inner wall 636 taken along the second virtual plane is formed in a circular arc shape of a virtual ellipse VC636 having the virtual line VLL3 as a major axis and the virtual line VLS3 as a minor axis. A length RL of the virtual line VLL3 is the same as a radius of the virtual circle VC335 and a ratio of a length RS of the virtual line VLS3 to the length RL of the virtual line VLL3 is set to be equal to or less than 0.5.

In the present embodiment, the cross section of the second inner wall 636 taken along the second virtual plane is formed so as to define a central angle of 180 degrees as viewed from a point on the injection hole axis HC63 (an angle A33 shown in FIG. 12). As a result, the second inner wall 636 is formed such that the cross section taken along the second virtual plane is plane-symmetrical with respect to the first virtual plane VP1 as a plane of symmetry.

The present applicant has conducted experiments on a relationship between a ratio of the length of a major axis and the length of a minor axis in the virtual ellipse VC636 and the spread degree Dsp of the fuel. The results are illustrated in FIG. 13. FIG. 13 shows the ratio of the length RS of the virtual line VLS3 to the length RL of the virtual line VLL3, and an axis of ordinate shows the spread degree Dsp of the fuel. As shown in FIG. 13, it has been proved that as the ratio of the length RS to the length RL increases more, the spread degree Dsp of the fuel increases more. From the viewpoint of the above fact, in order to set the spread degree Dsp of the fuel to 0.2 which is the indication that the influence of the shape change in the injection hole becomes relatively small, it is desirable to set the ratio of the length RS to the length RL to 0.5 or less.

In the present embodiment, the second inner wall 636 is located closer to the injection hole axis HC63 than the first inner wall 335 on which a relatively thick liquid film of the fuel is formed. As a result, the fuel injection valve 3 achieves the same advantages as those in the first embodiment. In addition, in the fuel injection valve 3, the injection hole 63 is formed so that the ratio of the length of the major axis to the length of the minor axis of the elliptical shape, which is the cross section of the second inner wall 636 taken along the second virtual plane, is set to 0.5 or less. As a result, the spread degree Dsp of the fuel becomes equal to or less than 0.2, and the fuel is unlikely to spread on the second inner wall 636. Therefore, the fuel injection valve 3 can further improve the stability of the fuel spray characteristics.

Fourth Embodiment

Next, a fuel injection valve according to a fourth embodiment of the present disclosure will be described with reference to FIG. 14. The fourth embodiment is different from the first embodiment in a shape of the injection hole. The substantially same portions as those in the first embodiment are denoted by the same reference signs, and a repetitive description will be omitted.

FIG. 14 shows a cross-sectional view of an injection nozzle 70 of a fuel injection valve 4 according to the fourth embodiment. FIG. 14 shows a cross section of an injection hole 73 of an injection nozzle 70 on a second virtual plane perpendicular to an injection hole axis HC73. In this example, only the injection hole 73 will be described, but the other injection holes of the fuel injection nozzle 70 also have the same features.

In the present embodiment, an injection hole passage 730 of the injection hole 73 is formed of a first inner wall 735 and a second inner wall 736. A cross section of the first inner wall 735 on a first virtual plane VP1 which is a plane including the injection hole axis HC73 and is parallel to a center axis CA30 is located on a valve closing direction side relative to the injection hole axis HC33 on the first virtual plane VP1. In addition, a cross section of the second inner wall 336 on a first virtual plane VP1 is located on a valve opening direction side relative to the injection hole axis HC33 on the first virtual plane VP1.

A cross section of the first inner wall 735 shown in FIG. 14, which is also a cross section of the injection hole 33, is formed in a circular arc shape of a virtual ellipse VC735 centered on a point on the injection hole axis HC73. In other words, the injection hole axis HC73 is also a line connecting the center of the virtual ellipse VC735 including the cross section of the first inner wall 735 taken along the second virtual plane as a part of the circumference. In the present embodiment, when an intersection line of the first virtual plane VP1 and the first inner wall 735 is taken as the first intersection line CL73, a cross section of the first inner wall 735 shown in FIG. 14 is formed so as to define a central angle of 90 degrees in each of the two circumferential directions from the point on the first intersection line CL73 when viewed from the point on the injection hole axis HC73 (angles A41 and A42 shown in FIG. 14). In other words, the first inner wall 735 is formed so that the cross section shown in FIG. 14 is plane symmetrical with respect to the first virtual plane VP1 as a plane of symmetry.

The cross section of the second inner wall 736 shown in FIG. 14 is located closer to the injection hole axis HC73 than the cross section of the first inner wall 735. In this example, in the cross section shown in FIG. 14, a virtual line that connects a connection point P73 between the first inner wall 735 and the second inner wall 736 and a point on the injection hole axis HC73 is defined as a virtual line VLL4. In addition, a virtual line that connects a point P736 on the second inner wall 736 and a point on the injection hole axis HC73, which is a virtual line intersecting perpendicularly with the virtual line VLL4 and extending in a direction of the second inner wall 736, is defined as a virtual line VLS4. In this case, a cross section of the second inner wall 736 taken along the second virtual plane is formed in a circular arc shape of a virtual ellipse VC736 having the virtual line VLL4 as a major axis and the virtual line VLS4 as a minor axis. Further, the length RL of the virtual line VLL3 is the same as that of the major axis of the virtual ellipse VC735. Further, the length RS of the virtual line VLS 4 is 0.5 times or less as large as the length RL.

In the present embodiment, the cross section of the second inner wall 736 taken along the second virtual plane is formed so as to define a central angle of 180 degrees as viewed from the point on the injection hole axis HC73 (an angle A43 shown in FIG. 14). As a result, the second inner wall 736 is formed such that the cross section taken along the second virtual plane is plane-symmetrical with respect to the first virtual plane as a plane of symmetry.

In the present embodiment, the second inner wall 736 is located closer to the injection hole axis HC73 than the first inner wall 735 on which a relatively thick liquid film of the fuel is formed. As a result, the fuel injection valve 4 achieves the same advantages as those in the first embodiment. In addition, in the fuel injection valve 4, the injection hole 73 is formed so that the ratio of the length of the major axis to the length of the minor axis of the elliptical shape, which is the cross section of the second inner wall 736 taken along the second virtual plane, is set to 0.5 or less. As a result, the fuel injection valve 4 can further reduce a variation in the fuel spray characteristics with time.

Fifth Embodiment

Next, a fuel injection valve according to a fifth embodiment of the present disclosure will be described with reference to FIGS. 15 and 16. The fifth embodiment is different from the first embodiment in that the first inner wall has a protrusion portion. The substantially same portions as those in the first embodiment are denoted by the same reference signs, and a repetitive description will be omitted.

FIG. 15 shows a cross-sectional view of an injection nozzle 75 of a fuel injection valve 5 according to the fifth embodiment. FIG. 15 shows a cross section of an injection hole 78 of the injection nozzle 75 on a second virtual plane perpendicular to an injection hole axis HC78. In this example, only the injection hole 78 will be described, but the other injection holes of the fuel injection nozzle 70 also have the same features.

In the present embodiment, an injection hole passage 780 of the injection hole 78 is formed of a first inner wall 785 and a second inner wall 336. A cross section of the first inner wall 785 on a first virtual plane VP1 which is a plane including the injection hole axis HC78 and is parallel to a center axis CA30 is located on a valve closing direction side relative to the injection hole axis HC78 on the first virtual plane VP1.

A cross section of a part of the first inner wall 785 shown in FIG. 15, which is also a cross section of the injection hole 33, is formed in a circular arc shape of a virtual ellipse VC785 centered on a point on the injection hole axis HC78. In other words, the injection hole axis HC787 is also a line connecting the center of the virtual ellipse VC785 including the cross section of the first inner wall 785 taken along the second virtual plane as a part of the circumference. In the present embodiment, the first inner wall 785 has a protrusion portion 788 that protrudes toward the injection hole axis HC78. In the cross section shown in FIG. 15, when an intersection line of an inner wall surface 789 of the protrusion portion 788 forming the injection hole passage 780 and the first virtual plane VP1 is taken as a first intersection line CL78, a point on the first intersection line CL78 is located closest to the injection hole axis HC 78 on the inner wall surface 789 of the protrusion portion 788. The inner wall surface 789 of the protrusion portion 788 is smoothly connected from a position of the first intersection line CL 78 to the circular arc shape of the virtual ellipse VC785. Accordingly, the cross section of the injection hole 78 is formed in a substantially M shape.

In the present embodiment, a cross section of the first inner wall 785 shown in FIG. 15 is formed so as to define a central angle of 90 degrees in each of the two circumferential directions from the point on the first intersection line CL78 when viewed from the point on the injection hole axis HC78 (angles A51 and A52 shown in FIG. 15). In other words, the first inner wall 785 is formed so that the cross section shown in FIG. 15 is plane symmetrical with respect to the first virtual plane VP1 as a plane of symmetry. In FIG. 15, for convenience, a virtual line VL5 that connects a connection point P53 between the first inner wall 785 and the second inner wall 336 and a point on the injection hole axis HC78 is shown. An end portion of the second inner wall 336 connected to the first inner wall 785 is formed to be smoothly connected to the first inner wall 785. As a result, the inner wall forming the injection hole passage 780 is curved.

Next, the operation of the fuel injection valve 5 according to the present embodiment will be described with reference to FIG. 16. FIG. 16 shows a cross section that is a cross-sectional view perpendicular to the injection hole axis HC78 of the injection hole 78 in the fuel injection valve 5. In the fuel injection valve 5, when the needle 40 is lifted from the valve seat 306, the fuel in the nozzle body 20 flows into the injection hole 78. The fuel flowing into the injection hole 78 forms a relatively thick liquid film LF7 of the fuel on a first inner wall 785. The liquid film of the fuel formed on the protrusion portion 788 in the liquid film of the fuel on the first inner wall 785 is likely to move in the circumferential direction of the injection hole passage 780 by leveraging the inclination of the inner wall surface 789 of the protrusion portion 788 (white arrows F16 in FIG. 16). As a result, the liquid film of the fuel on the first inner wall 785 is likely to spread over the first inner wall 785. Therefore, the fuel injection valve 5 achieves the advantages (1), (2), (4) to (6) of the first embodiment, and can further atomize the fuel.

Sixth Embodiment

Next, a fuel injection valve according to a sixth embodiment of the present disclosure will be described with reference to FIG. 17. The sixth embodiment is different from the first embodiment in a relationship of the shape of the injection hole. The substantially same portions as those in the first embodiment are denoted by the same reference signs, and a repetitive description will be omitted.

FIG. 17 shows a cross-sectional view of an injection nozzle 80 of a fuel injection valve 6 according to the sixth embodiment. FIG. 17 shows a cross section of an injection hole 83 of the injection nozzle 80 on a second virtual plane perpendicular to an injection hole axis HC83. In this example, only the injection hole 83 will be described, but the other injection holes of the fuel injection nozzle 80 also have the same features.

In the present embodiment, an injection hole passage 830 of the injection hole 83 is formed of a first inner wall 835 and a second inner wall 836. A cross section of the first inner wall 835 on a first virtual plane VP1 which is a plane including the injection hole axis HC83 and is parallel to a center axis CA30 is located on a valve closing direction side relative to the injection hole axis HC83 on the first virtual plane VP1. In addition, a cross section of the second inner wall 836 on a first virtual plane VP1 is located on a valve opening direction side relative to the injection hole axis HC83 on the first virtual plane VP1.

A cross section of the first inner wall 835 shown in FIG. 17, which is also a cross section of the injection hole 83, is formed in a circular arc shape of a virtual circle VC835 centered on a point on the injection hole axis HC83. In other words, the injection hole axis HC83 is also a line connecting the center of the virtual circle VC835 including the cross section of the first inner wall 835 taken along the second virtual plane as a part of the circumference.

In the present embodiment, when an intersection line of the first virtual plane VP1 and the first inner wall 835 is taken as a first intersection line CL83, a cross section of the first inner wall 835 taken along the second virtual plane perpendicular to the injection hole axis HC83 is formed so as to define a central angle of 90 degrees or more in each of the two circumferential directions from the point on the first intersection line CL83 when viewed from the point on the injection hole axis HC83 (angles A61 and A62 shown in FIG. 17). In other words, the first inner wall 835 is formed so that the cross section shown in FIG. 17 is plane symmetrical with respect to the first virtual plane VP1 as a plane of symmetry. In FIG. 17, for convenience, a virtual line VL6 that connects a connection point P63 between the first inner wall 835 and the second inner wall 836 and a point on the injection hole axis HC83 is shown.

The cross section of the second inner wall 836 shown in FIG. 17 is located closer to the injection hole axis HC33 than the cross section of the first inner wall 835. In addition, according to the present embodiment, the cross section of the second inner wall 836 shown in FIG. 17 is formed to define a central angle less than 180 degrees as viewed from the point on the injection hole axis HC 83 (an angle A63 shown in FIG. 17). An end portion of the second inner wall 836 connected to the first inner wall 835 is formed to be smoothly connected to the first inner wall 835. As a result, the inner wall forming the injection hole passage 830 is curved.

In the fuel injection valve 6, the second inner wall 836 located closer to the injection hole axis HC83 than the cross section of the first inner wall 835 is formed to define a central angle less than 180 degrees in cross section from the point on the injection hole axis HC83. As a result, the fuel injection valve 6 achieves the advantages (1), (3), and (5) in the first embodiment.

Seventh Embodiment

Hereinafter, a fuel injection valve according to a seventh embodiment of the present disclosure will be described with reference to FIG. 18. The seventh embodiment is different from the first embodiment in a relationship of the shape of the injection hole. The substantially same portions as those in the first embodiment are denoted by the same reference signs, and a repetitive description will be omitted.

FIG. 18 shows a cross-sectional view of an injection nozzle 85 of a fuel injection valve 7 according to the seventh embodiment. FIG. 18 shows a cross section of an injection hole 88 of the injection nozzle 85 on a second virtual plane perpendicular to an injection hole axis HC88. In this example, only the injection hole 88 will be described, but the other injection holes of the fuel injection nozzle 85 also have the same features.

In the present embodiment, an injection hole passage 880 of the injection hole 88 is formed of a first inner wall 885 and a second inner wall 886. A cross section of the first inner wall 885 on a first virtual plane VP1 which is a plane including the injection hole axis HC88 and is parallel to a center axis CA30 is located on a valve closing direction side relative to the injection hole axis HC88 on the first virtual plane VP1. In addition, a cross section of the second inner wall 886 on a first virtual plane VP1 is located on a valve opening direction side relative to the injection hole axis HC88 on the first virtual plane VP1.

A cross section of the first inner wall 885 shown in FIG. 18, which is also a cross section of the injection hole 88, is formed in a circular arc shape of a virtual circle VC885 centered on a point on the injection hole axis HC88. In other words, the injection hole axis HC88 is also a line connecting the center of the virtual circle VC885 including the cross section of the first inner wall 885 taken along the second virtual plane as a part of the circumference.

In the present embodiment, when an intersection line of the first virtual plane VP1 and the first inner wall 885 is taken as a first intersection line CL88, a cross section of the first inner wall 885 taken along the second virtual plane perpendicular to the injection hole axis HC88 is formed so as to define a central angle less than 90 degrees in each of the two circumferential directions from the point on the first intersection line CL88 when viewed from the point on the injection hole axis HC88 (angles A71 and A72 shown in FIG. 18). In other words, the first inner wall 885 is formed so that the cross section shown in FIG. 18 is plane symmetrical with respect to the first virtual plane VP1 as a plane of symmetry. In FIG. 18, for convenience, a virtual line VL7 that connects a connection point P73 between the first inner wall 885 and the second inner wall 886 and a point on the injection hole axis HC88 is shown.

The cross section of the second inner wall 886 shown in FIG. 18 is positioned closer to the injection hole axis HC88 than the cross section of the first inner wall 885. According to the present embodiment, the cross section of the second inner wall 886 shown in FIG. 18 is formed to define a central angle more than 180 degrees as viewed from the point on the injection hole axis HC 88 (an angle A73 shown in FIG. 17). An end portion of the second inner wall 886 connected to the first inner wall 885 is formed to be smoothly connected to the first inner wall 885. As a result, the inner wall forming the injection hole passage 880 is curved.

In the fuel injection valve 7, the second inner wall 886 located closer to the injection hole axis HC88 than the cross section of the first inner wall 885 is formed to define a central angle more than 180 degrees in cross section from the point on the injection hole axis HC88. As a result, the fuel injection valve 7 achieves the advantages (1), (3), and (5) in the first embodiment.

Other Embodiments

In the present embodiment described above, the cross section of the first inner wall taken along the second virtual plane is formed so as to define the central angle of the same angle in each of the two circumferential directions from the point on the first intersection line when viewed from the point on the injection hole axis. However, the central angle may not be the same.

In the third, fourth, and fifth embodiments, the cross section of the second inner wall taken along the second virtual plane intersecting perpendicularly with the injection hole axis is formed so as to define a central angle of 180 degrees as viewed from the point on the injection hole axis. However, the central angle of the second inner wall is not limited to the above examples. As in the sixth embodiment, the central angle may be less than 180 degrees, or may be more than 180 degrees as in the seventh embodiment.

In the sixth and seventh embodiments, the second inner wall may be formed in an arc shape of a virtual circle or a virtual ellipse. In that case, as in the third embodiment, the third inner wall may be provided between the first inner wall and the second inner wall. As a result, since the inner wall providing the injection hole passage is curved, the disturbance of the fuel flow can be restricted from occurring at a corner.

In the first embodiment, the second inner wall is formed such that the radius of the virtual circle including the cross section of the end portion of the second inner wall connected to the first inner wall as a part of the circular arc to the radius of the virtual circle including the cross section of the first inner wall as a part of the circular arc is set to 0.2 or less. In addition, in the second embodiment, the third inner wall is formed such that the radius of the virtual circle including the cross section of the third inner wall as a part of the circular arc to the radius of the virtual circle including the cross section of the first inner wall as a part of the circular arc is set to 0.2 or less. However, the relationship between those radii is not limited to the above example.

In the second embodiment, the angle formed between the first tangent line and the second tangent line is assumed to be 40 degrees or less. However, the angle formed between the first tangent line and the second tangent line is not limited to the above value. Further, the relationship that the angle formed between the first tangent line and the second tangent line is 40 degrees or less may also be applied to the first, third to seventh embodiments.

In the third embodiment, the relationship between the lengths of the major axis and the minor axis of the virtual ellipse having the cross section of the second inner wall as a part of an arc is such that the length of the minor axis to the major axis is 0.5 times or less. However, the relationship between the lengths of the major axis and the minor axis of the virtual ellipse is not limited to the above example.

In the second to fourth, sixth, and seventh embodiments, as in the fifth embodiment, the first inner wall may have a protrusion portion.

In the above embodiments, the cross sections of the first inner wall and the second inner wall taken along the second virtual plane are plane symmetric with respect to the first virtual plane as the plane of symmetry. However, the cross sections of the first inner wall and the second inner wall may not be plane symmetric.

In the first embodiment, there are six injection holes. The number of injection holes is not limited to the above number.

The present disclosure provides the fuel injection valve including the nozzle body, the needle, and the drive unit. The nozzle body has the injection hole capable of injecting the fuel and the valve seat formed around the inner opening of the injection hole. The needle is provided so as to be abuttable against the valve seat. The needle restricts the flow of fuel between the inside and the outside of the nozzle body through the injection hole when the needle abuts against the valve seat, and permits the flow of fuel between the inside and the outside of the nozzle body through the injection hole when the needle is lifted from the valve seat. The drive unit can reciprocate the needle. In the fuel injection valve of the present disclosure, the injection hole is formed so that the cross-sectional area of the inner opening is smaller than the cross-sectional area of the outer opening of the injection hole. Further, when the direction in which the needle reciprocating along the center axis of the nozzle body moves so as to abut against the valve seat is defined as the valve closing direction of the center axis, the injection hole passage communicating the inner opening and the outer opening is formed of the first inner wall formed on the valve closing direction side relative to the injection hole axis of the injection hole and the second inner wall formed on the side opposite to the valve closing direction side relative to the injection hole axis and located closer to the injection hole axis than the first inner wall.

In the fuel injection valve of the present disclosure, when the fuel in the nozzle body enters the injection hole passage through the inner opening, the fuel mainly flows along the first inner wall toward the outer opening. At this time, since the liquid film of the fuel flowing along the first inner wall spreads in the circumferential direction of the injection hole passage, the fuel also flows along the second inner wall. In the fuel injection valve of the present disclosure, since the second inner wall is located closer to the injection hole axis than the first inner wall, the liquid film of the fuel that tends to spread from the first inner wall to the second inner wall is unlikely to spread on the second inner wall, and the spread of the liquid film of the fuel is reduced. As a result, the spread of the liquid film of the fuel in the injection hole passage can be restricted from being greatly varied every time the fuel injection is performed. Therefore, since the fuel injection valve of the present disclosure can reduce a range of the spread of the fuel in a combustion chamber and a variation in the spray shape depending on the spread degree of the liquid film of the fuel, the stability of the spray characteristics of the fuel can be improved.

The present disclosure has been described based on the embodiments; however, it is understood that this disclosure is not limited to the embodiments or the structures. The present disclosure includes various modification examples and modifications within the equivalent range. In addition, it should be understood that various combinations or aspects, or other combinations or aspects, in which only one element, one or more elements, or one or less elements is included to the various combinations or aspects, are included in the scope or the technical idea of the present disclosure.

The invention claimed is:

1. A fuel injection valve comprising:

a nozzle body having an injection hole, which is configured to inject fuel, and a valve seat formed around an inner opening of the injection hole;

a needle abuttable against the valve seat, the needle configured to restrict fuel from flowing between an inside and an outside of the nozzle body through the injection hole when the needle abuts against the valve seat and to permit fuel to flow between the inside and the outside of the nozzle body through the injection hole when the needle is lifted from the valve seat; and a driver configured to move the needle back and forth, wherein the injection hole is formed such that its cross-sectional area is continually enlarged from the inner opening toward an outer opening of the injection hole, the needle is movable back and forth along a center axis of the nozzle body, the needle is movable in a valve closing direction along the center axis to abut against the valve seat, an injection hole passage of the injection hole communicates the inner opening with the outer opening, the injection hole passage is defined by a first inner wall and a second inner wall, the first inner wall is located in a valve closing direction to an injection hole axis of the injection hole, the second inner wall is located on a side opposite to the valve closing direction s-Me relative to the injection hole axis, the second inner wall is closer to the injection hole axis than the first inner wall, a plane Including the injection hole axis and facing the center axis or a plane including the injection hole axis and including the center axis is defined as a first virtual plane: and a cross section of the first inner wall taken along a second virtual plane, which intersects perpendicularly with the injection hole axis, is formed in a circular arc shape of a virtual circle centered on a point on the injection hole axis.

2. The fuel injection valve according to claim 1, wherein a plane including the injection hole axis and facing the center axis or a plane including the injection hole axis and including the center axis is defined as a first virtual plane, a cross section of the first inner wall on the first virtual plane is located on the valve closing direction relative to the nozzle hole axis on the first virtual plane, and a cross section of the second inner wall on the first virtual plane is located on a side opposite to the valve closing direction relative to the injection hole axis on the first virtual plane.

3. The fuel injection valve according to claim 2, wherein an intersection line between the first virtual plane and the first inner wall is defined as a first intersection line, a cross section of the first inner wall taken along the second virtual plane defines a central angle of 90 degrees or more in two circumferential directions from a point on the first intersection line.

4. The fuel injection valve according to claim 1, wherein a cross section of the second inner wall taken along the second virtual plane, defines a central angle of 180 degrees when viewed from a point on the injection hole axis.

5. The fuel injection valve according to claim 1, wherein a cross section of the first inner wall taken along the second virtual plane is formed in a circular arc shape of a virtual ellipse centered on a point on the injection hole axis.

6. The fuel injection valve according to claim 1, wherein a radius of curvature of a cross section of an end portion of the second inner wall on a first inner wall side taken along the second virtual plane is defined as a radius of curvature R2, a radius of curvature of the cross section of the first inner wall taken along the second virtual plane is defined as a radius R1, and R2/R1 is set to 0.2 or less.

7. The fuel injection valve according to claim 1, wherein the injection hole passage is defined by the first inner wall, the second inner wall, and a third inner wall between the first inner wall and the second inner wall, and a radius of curvature of a cross section of the third inner wall taken along the second virtual plane, is defined as a radius of curvature R3, a radius of curvature of the cross section of the first inner wall taken along the second virtual plane is defined as a radius R1, and R3/R1 is set to be equal to or less than 0.2.

8. The fuel injection valve according to claim 6, wherein a first tangent line, which is in contact with a cross section of an edge of the first inner wall on the second inner wall side taken along the second virtual plane, makes an angle of 40 degrees or more with a second tangent line, which is in contact with a cross section of an edge of the second inner wall on the first inner wall side taken along the second virtual plane.

9. The fuel injection valve according to claim 1, wherein a cross section of the second inner wall taken along the second virtual plane is formed in an arc shape of a virtual ellipse.

10. The fuel injection valve according to claim 9, wherein a length of a major axis of an ellipse including a cross section of the second inner wall taken along the second virtual plane as a part of a circular arc is defined as a length RL, a length of a minor axis of the ellipse including the cross section of the second inner wall taken along the second virtual plane as the part of the circular arc is defined as a length RS, and RS/RL is equal to or less than 0.5.

11. The fuel injection valve according to claim 1, wherein the first inner wall has a protrusion portion that protrudes in a direction of the injection hole axis.

12. The fuel injection valve according to claim 1, wherein a cross section of the injection hole passage taken along the second virtual plane is curved.

13. The fuel injection valve according to claim 1, wherein when a plane including the injection hole axis and facing the center axis or a plane including the injection hole axis and including the center axis is defined as a first virtual plane, a cross section of the first inner wall on the second virtual plane is plane symmetric with respect to the first virtual plane as a plane of symmetry.

14. The fuel injection valve according to claim 1, wherein when a plane including the injection hole axis and facing the center axis or a plane including the injection hole axis and including the center axis is defined as a first virtual plane, a cross section of the second inner wall on the second virtual plane is plane symmetric with respect to the first virtual plane as a plane of symmetry.

15. The fuel injection valve according to claim 1, wherein the second inner wall is formed throughout a length of the injection hole from the inner opening to the outer opening.

* * * * *